US006152062A

United States Patent [19]

Hattori

[11] Patent Number: 6,152,062

[45] **Date of Patent: *Nov. 28, 2000**

[54] SMALL WATERCRAFT WITH IMPROVED SUSPENSION SYSTEM

[75] Inventor: Toshiyuki Hattori, Shizuoka, Japan

[73] Assignee: Yamaha Hatsudoki Kabushiki Kaisha, Japan

[ * ] Notice: This patent is subject to a terminal disclaimer.

[21] Appl. No.: 09/088,647

[22] Filed: Jun. 1, 1998

[30] Foreign Application Priority Data

May 30, 1997 [JP] Japan ..... 9-142132
Jul. 23, 1997 [JP] Japan ..... 9-214150

[51] Int. Cl.[7] ..... B63B 8/00

[52] U.S. Cl. ..... 114/343; 114/55.5; 114/363

[58] Field of Search ..... 114/55.5, 55.53, 114/55.57, 363, 343

[56] References Cited

U.S. PATENT DOCUMENTS

| | | | |
|---|---|---|---|
| 2,561,156 | 7/1951 | Thorkildsen . | |
| 4,896,559 | 1/1990 | Marier et al. . | |
| 5,097,789 | 3/1992 | Oka . | |
| 5,255,626 | 10/1993 | Hattori et al. . | |
| 5,309,861 | 5/1994 | Mardikian . | |
| 5,367,978 | 11/1994 | Mardikian . | |
| 5,390,621 | 2/1995 | Hattori et al. . | |
| 5,490,474 | 2/1996 | Ikeda . | |
| 5,542,371 | 8/1996 | Harvey et al. . | |
| 5,542,862 | 8/1996 | Kobayashi . | |
| 5,622,132 | 4/1997 | Mardikian . | |
| 5,752,867 | 5/1998 | Koyanagi . | |
| 6,019,054 | 2/2000 | Hattori et al. | 114/55.57 |

*Primary Examiner*—Ed Swinehart
*Attorney, Agent, or Firm*—Knobbe, Martens, Olson & Bear, LLP

[57] ABSTRACT

An improved cushioning apparatus on a watercraft enhances the comfort of the ride, reduce rider fatigue, and cushion impact forces experienced by the watercraft hull, while allowing for convenient and easy access to various engine components for maintenance and repair of the engine. The cushioning apparatus absorbs at least a portion of any impact force which the rider experienced from the hull, as well as provides at least one degree of movement between the seated rider and the hull in order to cushion such impact forces. The cushioning apparatus may also isolate the rider, at least to some degree, from vibrations experienced by the hull. In one mode, the cushioning apparatus is connected to the watercraft by quick-disconnect fittings, which allow the seat and support frame to be easily moved away from an engine access opening for maintenance of the engine. Furthermore, a quick-access opening is disclosed which allows a rider to access various engine components without requiring that the cushioning apparatus be disconnected from the watercraft. Moreover, the cushioning apparatus increases the convenience and stability of the watercraft for heavier load conditions such as when multiple riders are riding on the watercraft.

42 Claims, 29 Drawing Sheets

SMALL WATERCRAFT WITH IMPROVED SUSPENSION SYSTEM

BACKGROUND OF THE INVENTION

1. Field of the Invention

The present invention relates in general to small watercraft, and in particular to a improved shock-absorbing apparatus for small watercraft.

2. Description of Related Art

Personal watercraft have become popular in recent years. This type of watercraft is sporting in nature; it turns swiftly, is easily maneuverable, and accelerates quickly. Personal watercraft today commonly carrier one rider and one or two passengers.

A relatively light weight, small hull of the personal watercraft defines an engine compartment below a rider's area. An internal combustion engine frequently lies within the engine compartment in front of a tunnel formed on the underside of the watercraft hull. The internal combustion engine commonly powers a jet propulsion device located within the tunnel. An impeller shaft commonly extends between the engine and the propulsion device for this purpose. Such small watercraft today are capable of traveling at high rates of speed.

Riders often experience noticeable vibrations, shocks and bumps as the relatively light-weight small hull, which travels quickly across a body of water. These jarring movements are acerbated as the watercraft meets waves and wakes on the water. The resultant rough ride contributes to rider fatigue.

Many riders also jump their watercraft off of wakes and waves. The landing, however, severely jars the rider, especially if the watercraft lands bow first. The rider conventionally must absorb all of the impact by using his or her legs and arms.

In order to improve the comfort of such a ride, to reduce rider fatigue and to cushion impact forces experienced by the watercraft hull, it has been discovered that cushioning apparatus can be provided on a watercraft to absorb at least a portion of any impact force which the rider experienced from the hull, as well as to provide a degree of movement between the rider and the hull in order to cushion such impact forces. Such cushioning apparatus can also isolate the rider, at least to some degree, from vibrations experienced by the hull.

Unfortunately, the incorporation of such cushioning apparatus into a watercraft is often associated with an increase in the complexity of the seat and rider support structure of the watercraft. Moreover, such cushioning apparatus do not allow the watercraft rider and/or maintenance personnel to conveniently access the engine and associated components of the watercraft for periodic, routine maintenance tasks. Accordingly, there exists a need for a watercraft cushioning structure that provides adequate support for a rider, but still allows for convenient access to the watercraft and/or associated engine components. Furthermore, there exists a need for such a cushioning apparatus that improves the convenience and versatility of the watercraft for heavy load conditions such as where multiple riders are riding on the watercraft.

SUMMARY OF THE INVENTION

The present invention provides significant support and cushioning for one or more riders of a watercraft, yet still allows for easy and convenient access to the watercraft engine compartment and associated components.

One aspect of the present invention thus involves a small watercraft comprising a hull defining an engine compartment beneath at least a portion of an upper deck with an internal combustion engine housed within the engine compartment driving a propulsion device to propel the watercraft. A rider's area includes a seat supported by a suspension system that operates between the seat and hull to absorb a portion of an impact force applied to the hull of the watercraft. The hull further includes an access opening, located at least in part beneath the seat, that opens into the engine compartment, the access opening being covered by a removable cover.

In accordance with an additional aspect of the present invention, a quick-access opening is formed in the engine cover located under the straddle-type seat. The seat is supported above the cushioning apparatus by a frame structure, said frame structure having a frame opening formed above the quick-access opening, whereby a rider may lift the straddle-type seat and conveniently and easy access the engine and associated components through the quick-release opening without requiring the rider to remove the entire seat structure and remove the engine cover.

In accordance with a further aspect of the present invention, the support member of a cushioning apparatus for a watercraft are distributed equidistantly about the center of gravity of the watercraft, such that the watercraft seat will not experience significant longitudinal movement resulting from forces impacting on the hull of the watercraft. This arrangement greatly increases the comfort of the ride, and significantly reduces rider fatigue.

In accordance with a further aspect of the present invention, a cushioning apparatus for a water craft is provided that incorporates a forward shock absorbing device having a greater spring constant that a rearward shock absorbing device. This arrangement tends to force the forward end of the watercraft towards the water during even rough water conditions, thereby improving the ability of the watercraft to attain the hump and planing positions. Furthermore, this invention allows heavy or even overweight individuals to utilize the watercraft without significantly reducing the performance of the watercraft.

BRIEF DESCRIPTION OF THE DRAWINGS

These and other features of the invention will now be described with reference to the drawings of preferred embodiments which are intended to illustrate and not to limit the invention, and in which.

DETAILED DESCRIPTION OF PREFERRED EMBODIMENTS OF THE INVENTION

Figure 1:
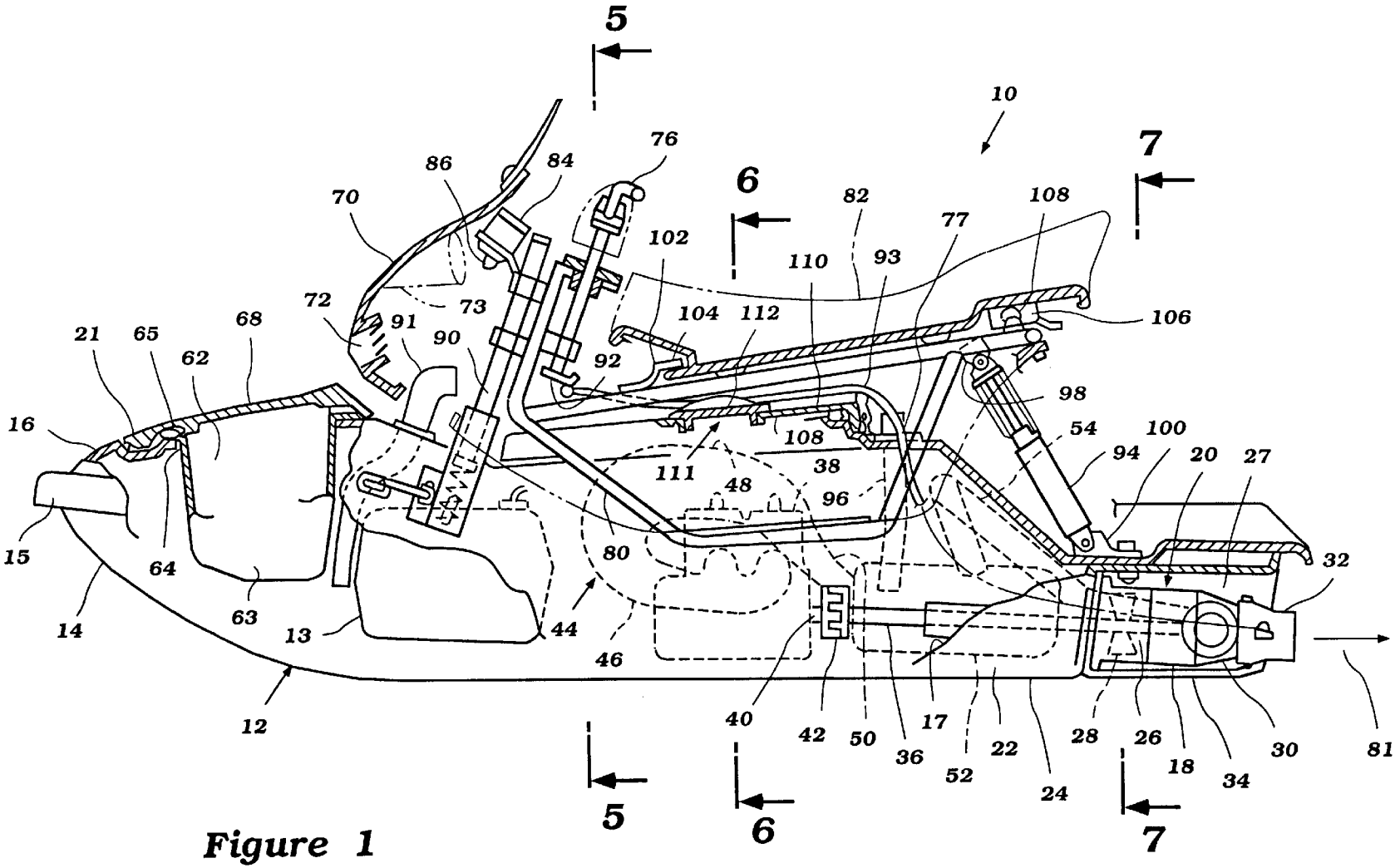
FIG. 1 is a partial sectional side elevational view of a personal watercraft including a cushioning apparatus configured in accordance with a preferred embodiment of the present invention.
Figure 2:
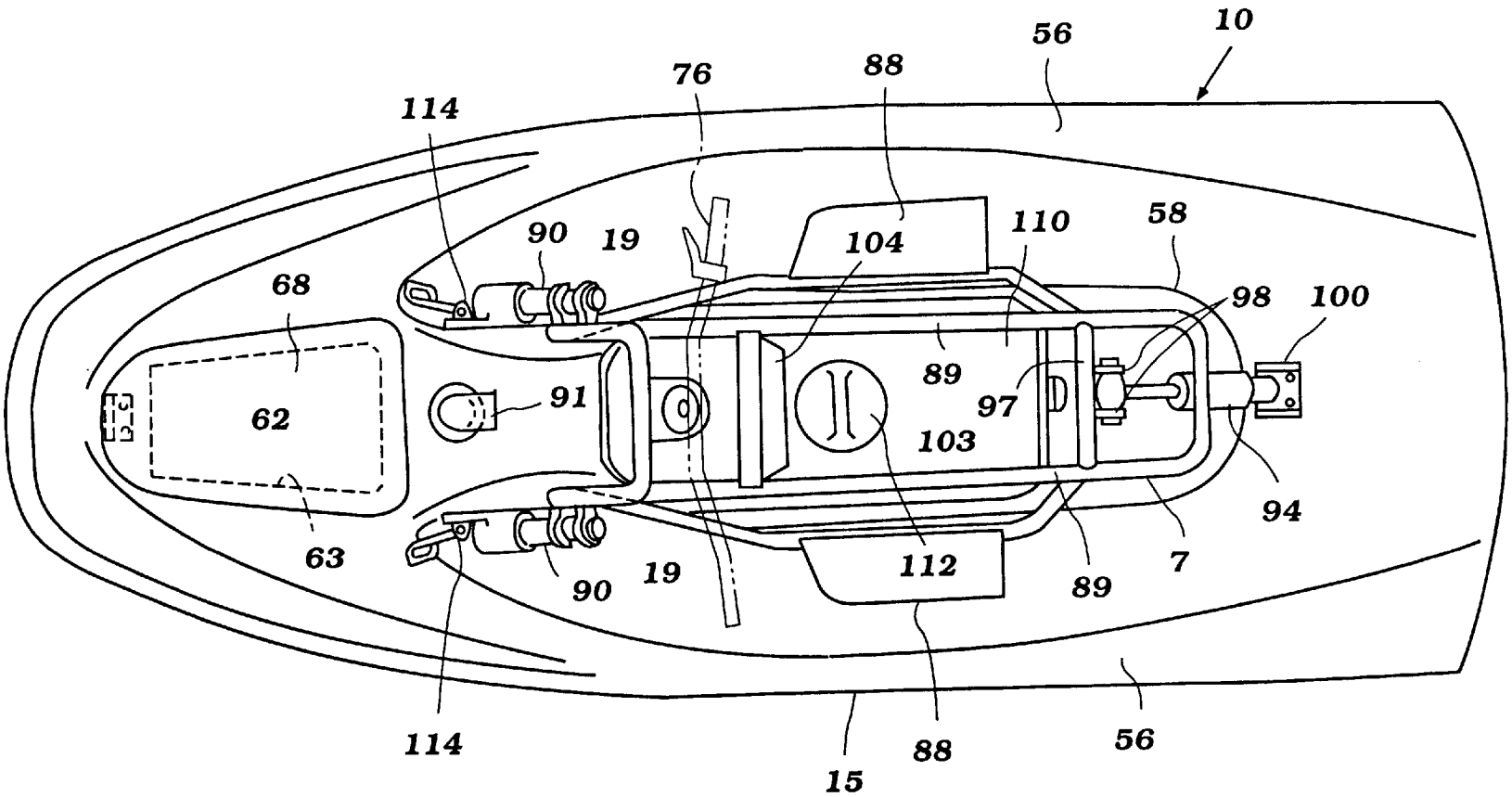
FIG. 2 is a top plan view of the watercraft of FIG. 1, with the rider seat and protective cowling removed.

Several embodiments of an exemplary watercraft with a cushioning apparatus are disclosed herein. Each of these embodiments employ the same basic concepts characteristic of the improved features of the cushioning apparatus, namely a system that provides for easy and convenient access to the watercraft engine and associated components while reducing a rough ride experienced by a rider. The cushioning apparatus provides at least one degree a freedom to the steering operator, and in some embodiments, the cushioning apparatus provides one or more degrees of freedom to a rider assembly on which the entire rider rides. The cushioning apparatus also absorbs at least a portion of any impact experienced by the hull during riding and can essentially decouple the rider from vibrations experienced by the watercraft hull. The cushioning apparatus can also be easily rotated away from engine access points, or may be bypassed through various openings, thereby allowing quick and convenient access to various engine components.

The present cushioning apparatus has particular utility for use with personal watercraft, and thus, the following describes the cushioning apparatus in the context of a personal watercraft. This environment of use, however, is merely exemplary. The present cushion apparatus can be readily adapted by those skilled in the art for use with other types of watercraft as well, such as, for example, but without limitation, small jet boats and the like.

With initial reference to the embodiment illustrated in FIGS. 1–8, the watercraft 10 includes a hull 12 that is formed by a lower hull section 14 and an upper deck section 16. The hull sections 14, 16 are formed of a suitable material such as, for example, a molded fiberglass reinforced resin or plastic. The lower hull section 14 and the upper deck section 16 are fixed to each other around the peripheral edges 15 in any suitable manner.

The lower hull 14 is designed such that the watercraft 10 planes or rides on a minimum surface area of the aft end of the lower hull 14 in order to optimize the speed and handling of the watercraft 10 when up on plane. For this purpose, the lower hull section generally has a V-shaped configuration formed by a pair of inclined sections that extend outwardly from the keel line to outer chines at a dead rise angle θ (see FIG. 5). The inclined sections extend longitudinally from the bow toward the transom of the lower hull 14 and extend outwardly to side walls of the lower hull. The side walls are generally flat and straight near the stern of the lower hull and smoothly blend towards the longitudinal center of the watercraft at the bow. The lines of intersection between the inclined section and the corresponding side wall form the outer chines of the lower hull section.

Toward the transom of the watercraft, the incline sections of the lower hull extend outwardly from a recessed channel or tunnel 18 that extends upward toward the upper deck portion 16. The tunnel 18 has a generally parallelepiped shape and opens through the rear of the transom of the watercraft 10.

In the illustrated embodiment, a jet pump unit 20 located in a pump chamber 27 propels the watercraft 10. The jet pump unit 20 is mounted within the tunnel 18 formed on the underside of the lower hull section 16 by a plurality of bolts. An intake duct 22 of the jet pump unit 20 defines an inlet opening 24 that opens into a gullet or water pipe 17. The gullet leads to an impeller housing 26 in which the impeller 28 of the jet pump 20 operates. An impeller duct assembly, which acts as a pressurization chamber, delivers the water flow from the impeller housing 26 to a discharge nozzle housing 30. A steering nozzle 32 is supported at the downstream end of the discharge nozzle by a pair of vertically extending pivot pins.

A ride plate 34 covers a portion of the tunnel 18 behind the inlet opening to enclose the pump chamber and the nozzle assembly 30 within the tunnel 18. In this manner, the lower opening of the tunnel 18 is closed to provide in part a planing surface for the watercraft.

An impeller shaft 36 supports the impeller 28 within the impeller housing 26. The aft end of the impeller shaft 36 is suitably supported and journalled within the compression chamber in a known manner. The impeller shaft 36 extends in the forward direction through a front wall of the tunnel 18

The lower hull portion 14 principally defines the engine compartment. Except for some conventional air ducts, the engine compartment is normally substantially sealed so as to enclose an engine and the fuel system of the watercraft 10 from the body of water in which the watercraft is operated.

An internal combustion engine 38 of the watercraft powers the impeller shaft 36 to drive the impeller 28 of the jet pump unit 20. The engine 38 is positioned within the engine compartment and is mounted centrally within the hull 12. Vibration-absorbing engine mounts 25 secure the engine 38 to the lower hull portion 14 in a known manner.

In the illustrated embodiment, the engine 18 includes two in-line cylinders and operates on a two-stroke, crankcase compression principle. The engine 38 is positioned such that the row of cylinders lies parallel to a longitudinal axis of the watercraft 10, running from bow to stern. This engine type, however, is merely exemplary. Those skilled in the art will readily appreciate that the present fuel delivery system can be used with any of a variety of engine types having other number of cylinders, having other cylinder arrangements and operating on other combustion principles (e.g., four-stroke principle).

A cylinder block and a cylinder head assembly desirably form the cylinders of the engine. A piston reciprocates within each cylinder of the engine 38 and together the pistons drive an output shaft 40, such as a crankshaft, in a known manner. A connecting rod links the corresponding piston to the crankshaft 40. The corresponding cylinder bore, piston and cylinder head of each cylinder forms a variable-volume chamber, which at a minimum volume defines a combustion chamber.

The crankshaft 40 desirably is journalled with a crankcase, which is formed between a crankcase member and a lower end of the cylinder block. Individual crankcase chambers of the engine are formed within the crankcase by dividing walls and sealing disks, and are sealed from one another with each crankcase chamber communicating with a dedicated variable-volume chamber. Each crankcase chamber also communicates with a charge former of an induction system through a check valve (e.g., a reed-type valve). The induction system receives fuel from a fuel tank 13, which is positioned within the hull 12, transferring this fuel to a carburetor (not shown) which produces the fuel charge delivered to the cylinders in a known manner. Because the internal details of the engine 38, the induction system and details of the fuel supply system desirably are conventional, a further description of these components is not believed necessary to understand and practice the invention.

As seen in FIG. 1, a coupling 42 interconnects the engine crankshaft 40 to the impeller shaft 36. A bearing assembly (not shown), which is secured to the bulkhead, supports the impeller shaft 36 behind the shaft coupling 42.

An exhaust system 44 is provided to discharge exhaust byproducts from the engine 38 to the atmosphere and/or to the body of water in which the watercraft 10 is operated. The exhaust system 44 includes an exhaust manifold that is affixed to the side of the cylinder block and which receives exhaust gases from the variable-volume chambers through exhaust ports in a well-known manner.

An outlet end of the exhaust manifold communicates with a C-shaped pipe section 46. This C-pipe 46 includes an inner tube that communicates directly with the discharge end of the exhaust manifold. An outer tube surrounds the inner tube to form a coolant jacket between the inner and outer tubes. Although not illustrated, the C-pipe 46 includes an inlet port positioned near its inlet end. The inlet port communicates with a water jacket of the engine 38.

The outlet end of the C-pipe 46 communicates with an expansion chamber 48. In the illustrated embodiment, the expansion chamber has a tubular shape in which an expansion volume is defined within an annular, thick wall. Coolant jacket passages extend through the expansion chamber wall and communicate with the coolant jacket of the C-pipe 46.

A flexible coupling (not shown) connects the outlet end of the C-pipe 46 to the inlet end of the expansion chamber 48. The flexible coupling also can includes an outlet port which communicates with an internal coolant passage within the flexible coupling. The coolant passage places the coolant jacket and the coolant passages in communication.

The outlet end of the expansion chamber 48 is fixed to a reducer pipe which tapers in diameter toward its outlet. The pipe has a dual shell construction formed by an inner shell which defines an exhaust flow passage. The expansion volume communicates with this passage.

An outer shell is connected to the inner shell and defines a cooling jacket about the inner shell of the reducer pipe. The coolant jacket passages of the expansion chamber communicate with the coolant jacket of the pipe to discharge a portion of the coolant with the exhaust gases.

If desired, a catalyzer can be disposed within the space defined at the mating ends of the expansion chamber and the reducer pipe. For instance, the catalyzer can include an annular shell supporting a honeycomb-type catalyst bed. The catalyst bed is formed of a suitable catalytic material such as that designed to treat and render harmless hydrocarbons, carbon monoxide, and oxides of nitrogen. An annular flange supports the annular shell generally at the center of the flow path through the expansion chamber volume. In this manner, all exhaust gas flow through the expansion chamber passes through the catalyst bed. The annular flange can be held between outlet end of the expansion chamber and the inlet end of the reducer pipe.

The lower section of the reducer pipe includes a downwardly turned portion that terminates at the discharge end. The inner shell stops short of the outer shell such that the water flow through the water jacket merges with the exhaust gas flow through the exhaust passage at the discharge end.

A flexible pipe 50 is connected to the discharge end of the reducer pipe and extends rearward along one side of the watercraft hull tunnel 18. The flexible conduit 50 connects to an inlet section of a water trap device 52. The water trap device 52 also lies within the watercraft hull 12 on the same side of the tunnel 18.

The water trap device 52 has a sufficient volume to retain water and to preclude the back flow of water to the expansion chamber 48 and the engine 38. Internal baffles within the water trap device 52 help control water flow through the exhaust system 44.

An exhaust pipe 54 extends from an outlet section of the water trap device 52 and wraps over the top of the tunnel 18 to a discharge end. The discharge end desirably opens into the tunnel 18 at an area that is close to or actually below the water level with the watercraft 10 floating at rest on the body of water.

The personal watercraft 10 so far described represents only an exemplary watercraft on which the present cushioning apparatus can be employed. A further description of the personal watercraft 10 is not believed necessary for an understanding and an appreciation of the present invention. The cushioning apparatus and its arrangement on the upper deck 16 will now be described in detail.

The upper deck 16 and the lower hull portion 14 together define a pair of raised gunnels 56 positioned on opposite sides of the aft end of the upper deck assembly 16. The raised gunnels 56 define a pair of foot areas 19 that extend generally longitudinally and parallel to the sides of the watercraft 10. In this position, the operator and any passengers sitting on the watercraft 10 can place their feet in the foot areas 19 with the raised gunnels 56 shielding the feet and lower legs of the riders. A non-slip (e.g., rubber) mat desirably covers the foot areas 19 to provide increased grip and traction for the operator and the passengers.

Toward the forward end of the watercraft, a storage opening 62 is formed in the upper deck 16 in front of the steering operator 76. A storage box 63 is disposed within the storage opening 62, with the flanged edges of the storage box abutting against the outer edge of the storage opening in a manner well known to those skilled in the art. The storage opening is covered by a storage cover 68, which abuts against one or more seals 65, sealing the storage container in a watertight manner. If desired, the storage cover may be mounted to the upper deck 16 by a hinge 21.

Toward the aft end of the watercraft, a seat pedestal 58 rises above the foot areas. A windscreen 70 is positioned in front of the seat pedestal, which deflects wind and/or water away from the rider while the watercraft is traveling in a forward direction. The windscreen 70 supports a pair of mirrors 73 and incorporates a front facing air intake 72 which allows air to pass through the windscreen while restricting the passage of significant amounts of water, thereby cooling the riders and supplying air for the engine air intakes while preventing water from impacting the rider and/or engine components.

A forward air intake 91 and a rear air intake 96 provide air to the engine compartment. The forward air intake 91 desirably terminates at a location between the windscreen and the upper deck, with the upper end of the air intake extending above the upper deck so as to prevent water on the upper deck from traveling down into the air intake and into the engine compartment. As depicted in this embodiment, the forward air intake 91 further incorporates an opening which faces towards the rear of the watercraft, which allows air to freely flow through the forward air intake and into the engine compartment to provide cooling and/or combustion air for the engine, while limiting the flow of water into the engine compartment. Although not depicted, forward air ventilation may be comprised of a plurality of such forward air openings, with these air openings positioned such that at least one of the forward air openings communicates with the atmosphere even when the watercraft is in various orientations such as on its side or stern-down. In one mode, the air vent conduits can have a crossing orientation such that ends of each conduit lies on opposite sides of a central longitudinal plane of the watercraft.

The rear air intake 96 also communicates with the engine compartment, and extends up through the upper deck 16 of the watercraft to terminate between the upper deck and the seat 82. As with the forward air intake, the rear air intake desirably extends above the upper deck, which acts to prevent water on the upper deck from traveling down through the rear air intake and into the engine compartment. The rear air intake 96 may similarly be comprised of a plurality of such openings.

Figure 5:
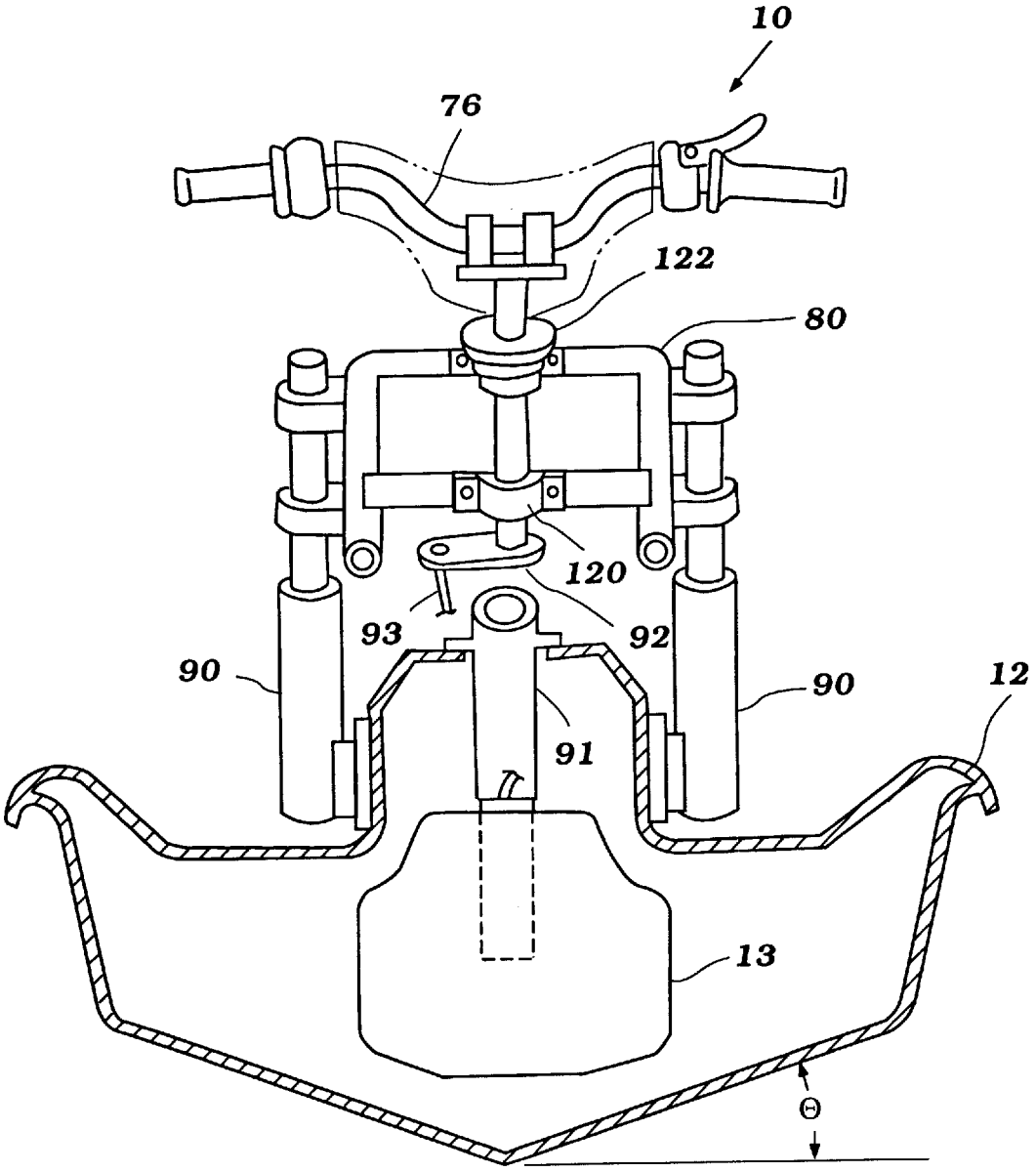
FIG. 5 is a rear sectional view of the watercraft of FIG. 1, taken along line 5—5.
Figure 6:
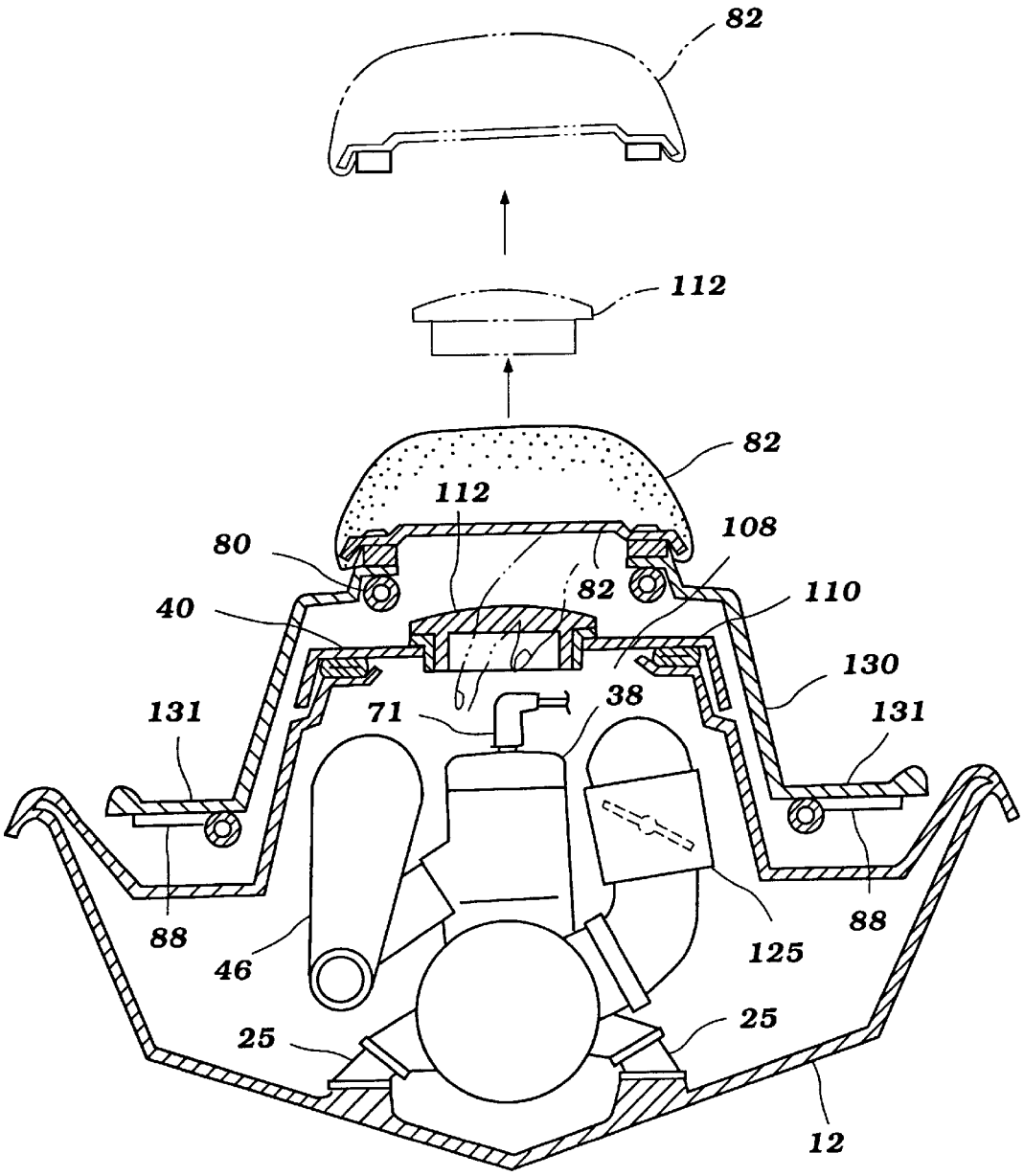
FIG. 6 is a rear sectional view of the watercraft of FIG. 1, taken along line 6—6, showing the rider seat and quick-access cover removed to allow access to the engine compartment.
Figure 7:
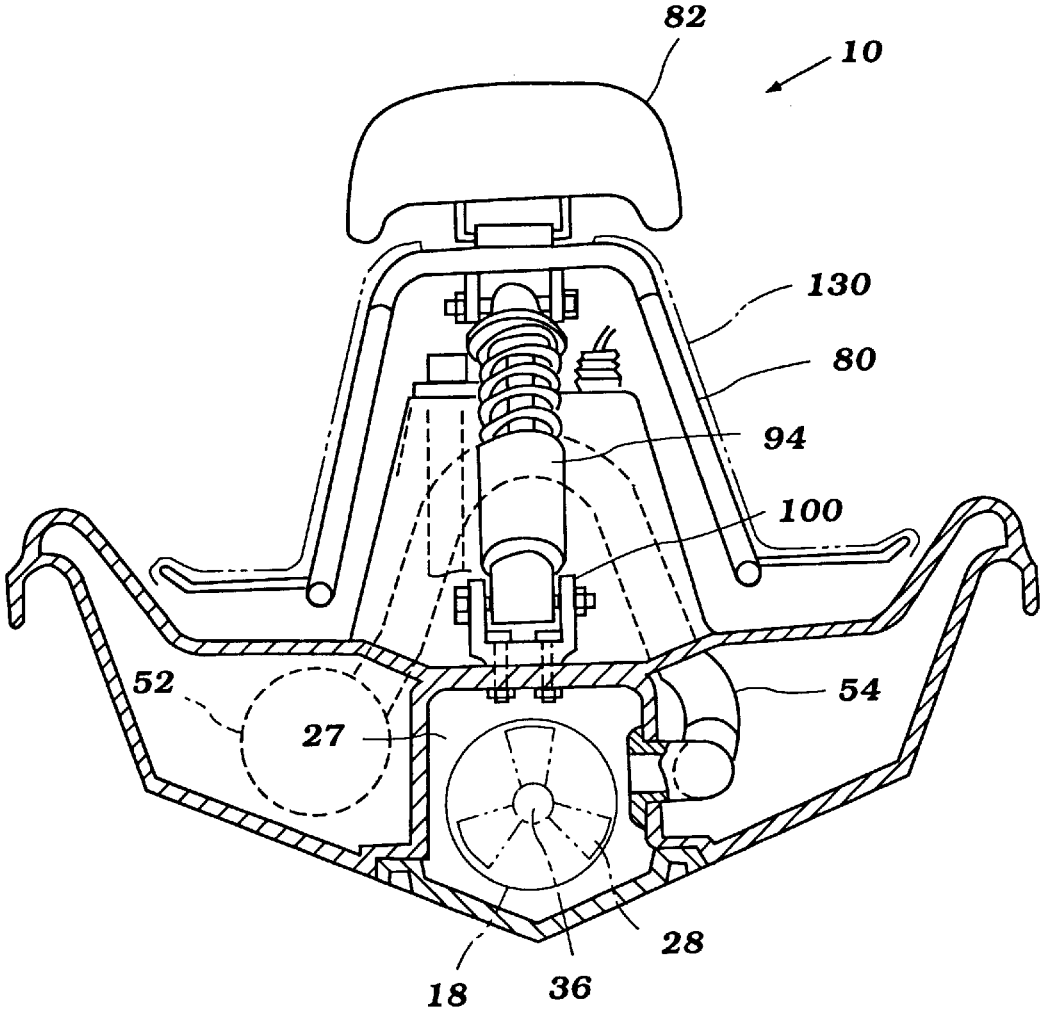
FIG. 7 is a rear sectional view of the watercraft of FIG. 1, taken along line 7—7.
Figure 8:
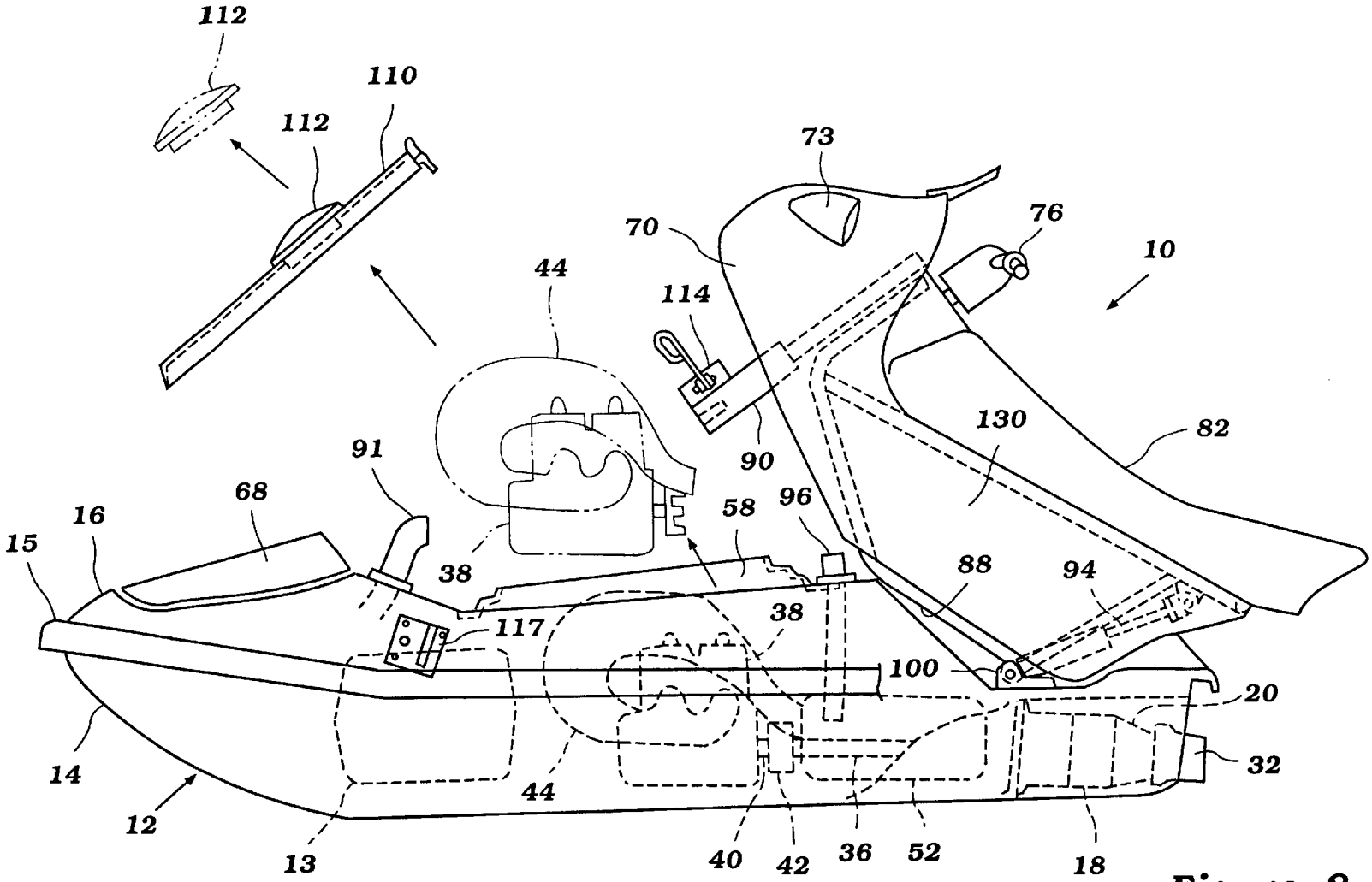
FIG. 8 is a partial sectional side view of the watercraft of FIG. 1, with the support frame and protective cowling rotated away from the engine cover.

A support frame 80, positioned above the pedestal 58, supports the elongated seat 82, the steering operator 76, various engine meters 84 and associated bracket 86, and a pair of footrests 88. The support frame incorporates a pair of longitudinally extending frame members 89, which are strengthened by strut members 95 and 97 in a manner well known in the art. The steering operator 76 is rotatable secured to the support frame by one or more rotatable couplings or bearings 120 and 122, which secure the steering operator 76 in place yet allow it to freely rotate. In the illustrated embodiment, as best seen in FIG. 5, a lever 92 projects from the lower end of the steering operator 76. A steering cable 93, such as a bowden-wire actuator, is attached to the lever 92 such that rotational movement of the steering operator 76 actuates the steering cable 93 in a conventional manner. The bowden-wire actuator passes through a cable opening 77 in the watercraft hull and in turn moves the steering nozzle 32 to effect directional changes of the water jet 81 exiting the watercraft 10. It is understood, however, that the present cushioning apparatus can be used with a steering operator that operates a steering device using other types of steering actuators, such as, for example, those that employ a fly-by wire.

Two shock absorbers 90 support the forward end of the support frame 80 above the pedestal 58, and a single shock absorber 94 supports the rear end of the support frame 80. These shock absorbers together define a suspension system. The forward shock absorbers 90 are positioned in front of and on either side of the steering operator 76, and permit the forward portion of the support frame 80 to move vertically along the longitudinal axis of the shock absorbers 90 in response to forces exerted on the watercraft hull 12. Similarly, the rear shock absorber 94 permits the rear portion of the support frame 80 to move vertically. The rear shock absorber is rotatably secured to the frame 80 and the upper deck 16 by rotatable couplings 98 and 100, which allow the rear shock absorber 94 to shift orientation slightly when the frame 80 alters its vertical position in response to forces acting on the watercraft hull 12.

The forward edge of the seat 82 is secured to the frame 80 by a seat projection 102 which engages a corresponding engaging piece 104 on the frame 80. The rear edge of the seat 82 is secured to the frame 80 by a seat lock 106 which engages a keeper 108 on the frame 80. This quick-release latching assembly allows the seat to be easily and conveniently removed in a manner well known to those skilled in the art.

An engine opening 108 is formed in the upper deck 16 underneath the frame 80 and seat 82. An engine cover 110 covers and seals the engine opening 108 in a watertight manner. A quick-access opening 111 is formed in the engine cover 110, this quick access opening being covered by a quick-access cover 112, which also seals the quick-access opening in a watertight manner. A conventional latch or similar mechanism (not shown) releasably secures the engine cover 110 and quick-access cover 112 in their respective openings. Both the engine opening 108 and the quick-access opening 111 open into the engine compartment formed within the hull 12.

Figure 3:
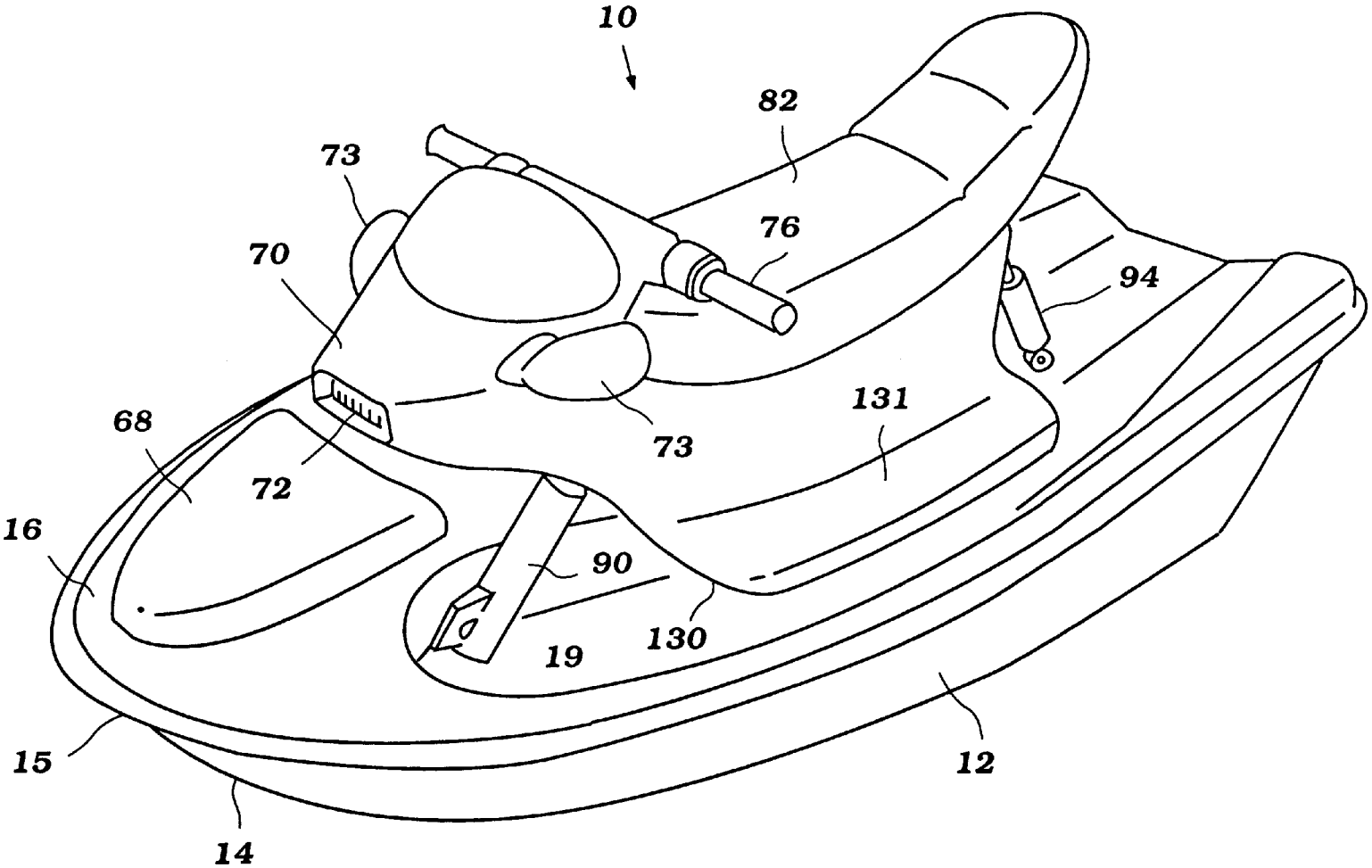
FIG. 3 is a perspective view of the watercraft of FIG. 1.
Figure 4:
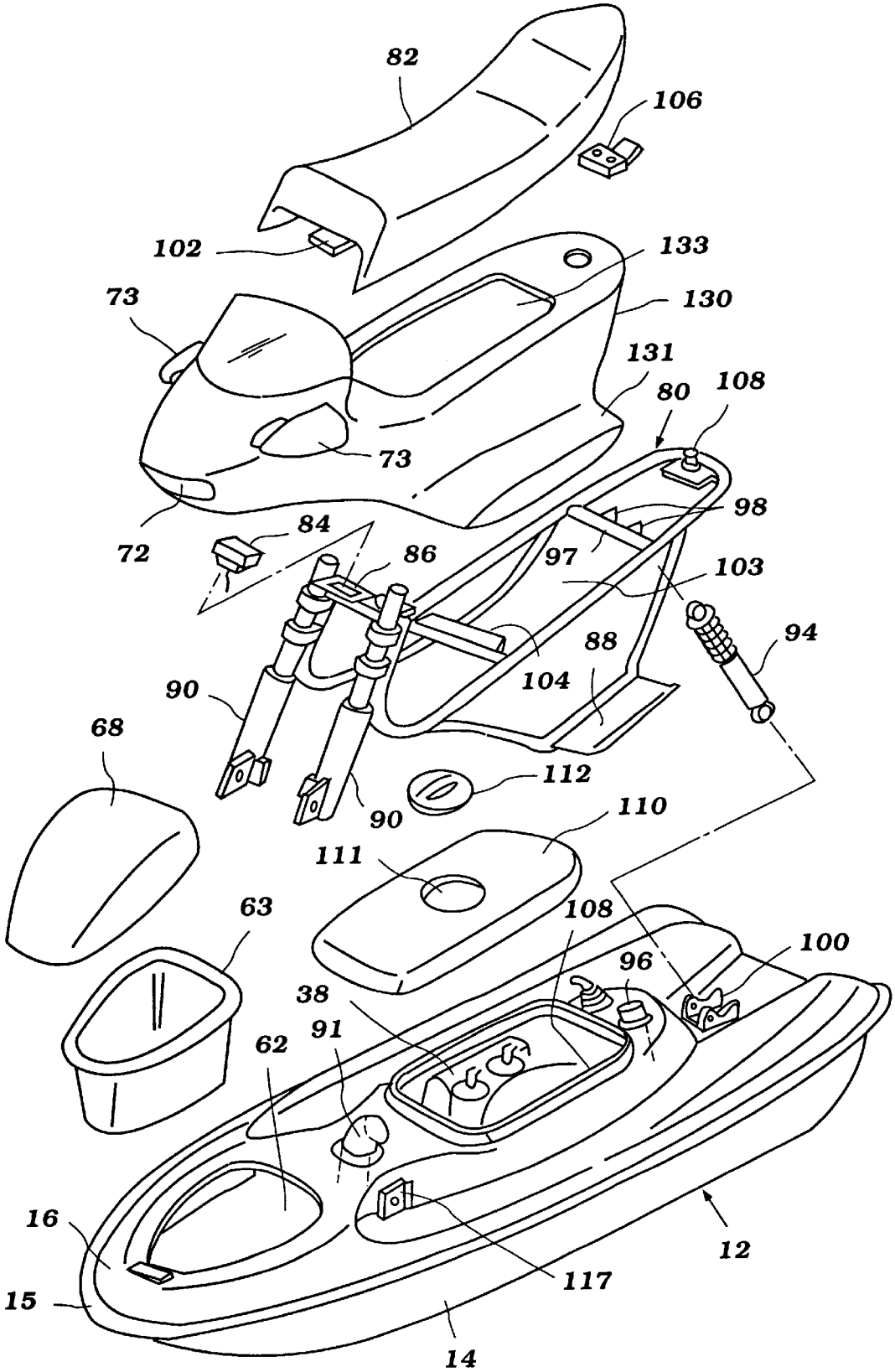
FIG. 4 is an exploded perspective view of the watercraft of FIG. 3.

As can be best seen in FIGS. 3 and 4, a protective cowling 130 is formed integrally with the windscreen 70, which is attached to and surrounds the frame 80, with the lower section of the cowling 130 forming foot rests 131 along each side of the frame above the footrests 88. This cowling 130 moves vertically with the support frame 80, and prevents a riders legs and feet from being pinched between the frame 80 and the pedestal 58 if a large force is applied to the watercraft hull 12. A cowling opening 133 is formed in the cowling 130 beneath the seat 82, which allows a rider to access the engine compartment as will be discussed later.

Figure 9:
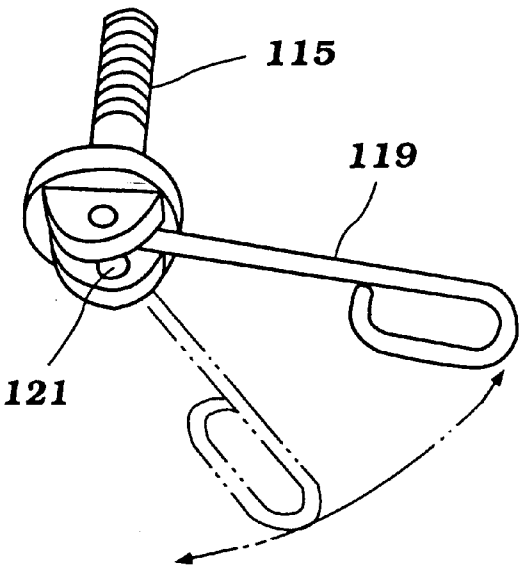
FIG. 9 is a perspective view of a quick-release bolt.

In the embodiment disclosed in FIGS. 1–8, a quick-release bolt 114 secures the lower end of each of the forward shock absorbers 90 to a bracket 117 disposed in the upper deck 16. As can best be seen in FIG. 9, the quick-release bolt 114 comprises a bolt 115 attached to a lever 119 by a pin 121 which allows the lever to be rotated relative to the bolt 115.

Figure 10:
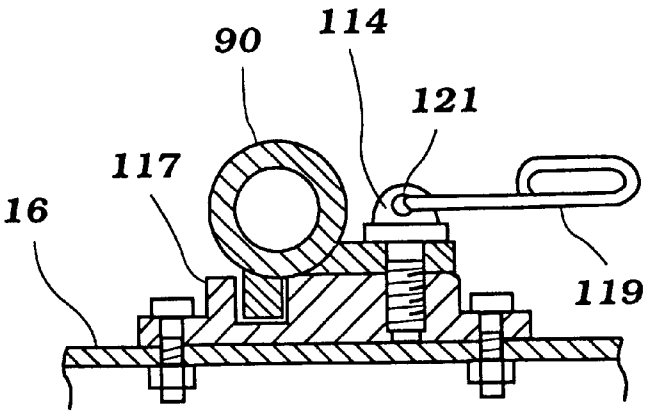
FIG. 10 is a partial cross-sectional view of the watercraft of FIG. 1, showing a quick-release bolt securing a forward shock absorber to the upper deck of the watercraft.

FIG. 10 depicts a forward shock absorber 90 attached to the bracket 177 in the upper deck 16. In order for the shock absorber 90 to removed from the bracket 177, the quick release bolt 114 must be unscrewed from the bracket 177. During normal operation of the watercraft, the flat position of the lever 119 resists rotation of the bolt 114, thereby preventing accidental decoupling of the shock absorber 90 from the bracket 177. When the lever is lifted away from the shock absorber 90, however, the bolt can be freely rotated and removed, thereby releasing the shock absorber 90 from the bracket 177.

When the quick release bolt 114 is removed from each of the forward shock absorbers 90, the forward shock absorbers 90 can be separated from the upper deck 16, and thus the support frame will be secured to the upper deck 16 by the rotatable couplings 98 and 100 between the seat, rear shock absorber, and upper deck. The front of the support frame 80 may then be lifted and rotated away from the pedestal 58 around the rotatable couplings, which exposes the engine cover 110 and engine opening 108 and allows easy and convenient access to the engine compartment.

Moreover, for minor maintenance such as replacement of spark plugs 71, the present invention allows a rider to access the engine compartment without requiring the removal of the support frame assembly. Because the center 103 of the support frame and the center 133 of the protective cowling are open above the quick-access opening, the rider can quickly remove the seat 82 and the quick-access cover 112 while the support frame and protective cowling remain firmly attached to the upper deck.

FIGS. 11–14, 15–17, 18–23, 24–26 and 27–32 illustrate watercraft constructed in accordance with various additional embodiments of the present invention. Most of the basic components of the watercraft are the same between the embodiments, except for the cushioning apparatus (i.e., the suspension system) and structure and a few components of the upper deck. In order to ease the reader's understanding, like reference numerals with lettered suffixes are used to indicate like components between these embodiments.

Figure 11:
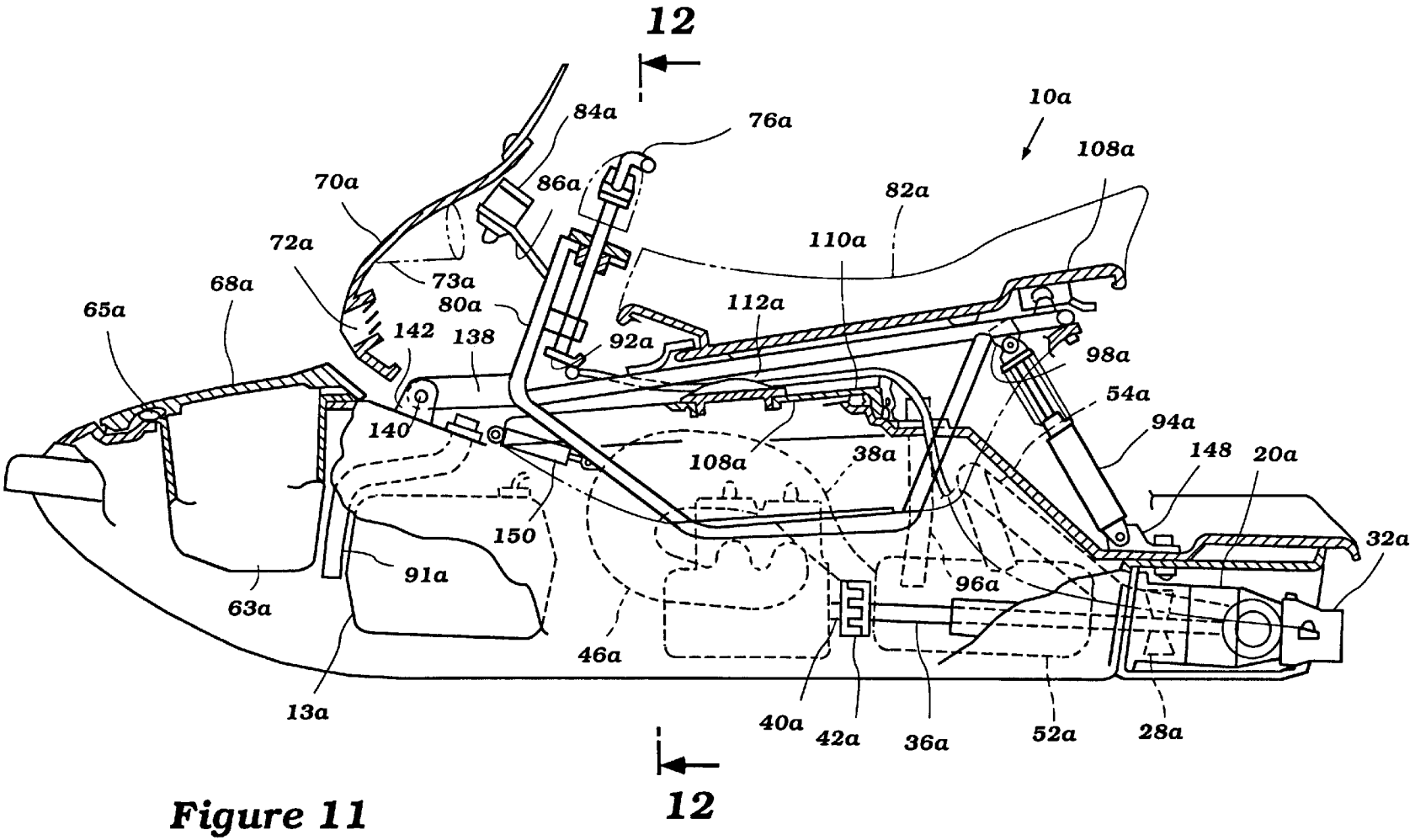
FIG. 11 is a partial sectional side elevational view of a personal watercraft including a cushioning apparatus configured in accordance with an alternate embodiment of the present invention.
Figure 12:
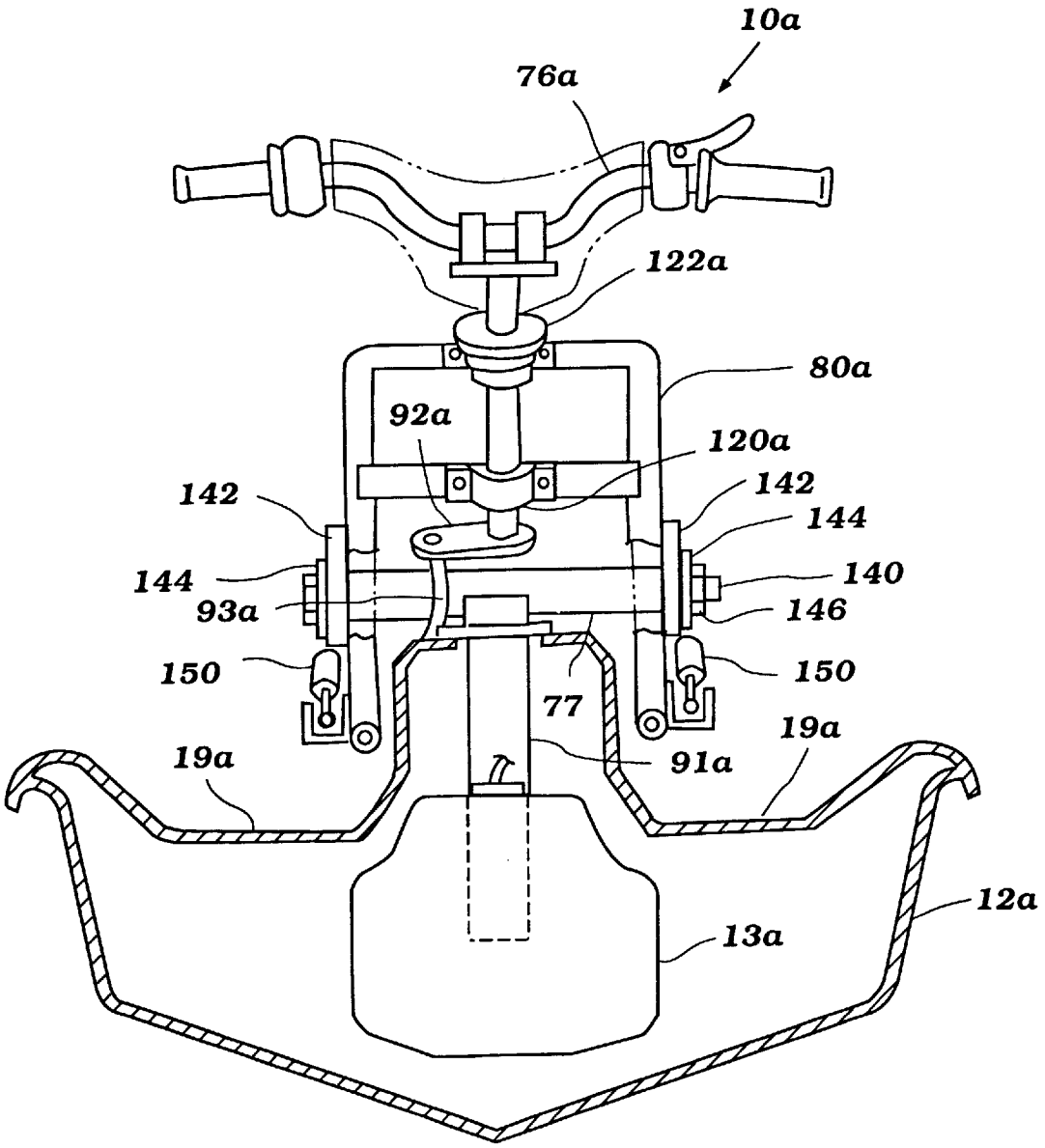
FIG. 12 is a sectional view of the watercraft of FIG. 11, taken along line 12—12.

FIG. 11 depicts a watercraft constructed in accordance with an alternate embodiment of the present invention. The suffix "a" has been added to the like reference numerals to indicate like components between this embodiment and the one described above. In this embodiment, two arms 138, connected to the support frame 80*a*, are rotatably connected through bearings 79 to brackets 142 on the upper deck 16*a* of the watercraft 10*a* by a bolt 140 or other means. As best seen in FIG. 12, the bolt 140 is secured to the brackets 142 by means of one or more washers 144 and a nut 146, and a sleeve 77 covers the central section of the bolt 140. The rear portion of the support frame 80*a* is rotatably attached to a rear shock absorber 90*a*, which in turn is rotatably connected to the upper deck 16*a* by a quick-release coupling 148. In this embodiment, the aft portion of the seat, which is supported by the shock absorber, can move in the vertical direction more freely than the front section of the seat, which is rotatably secured to the upper deck.

Figure 13:
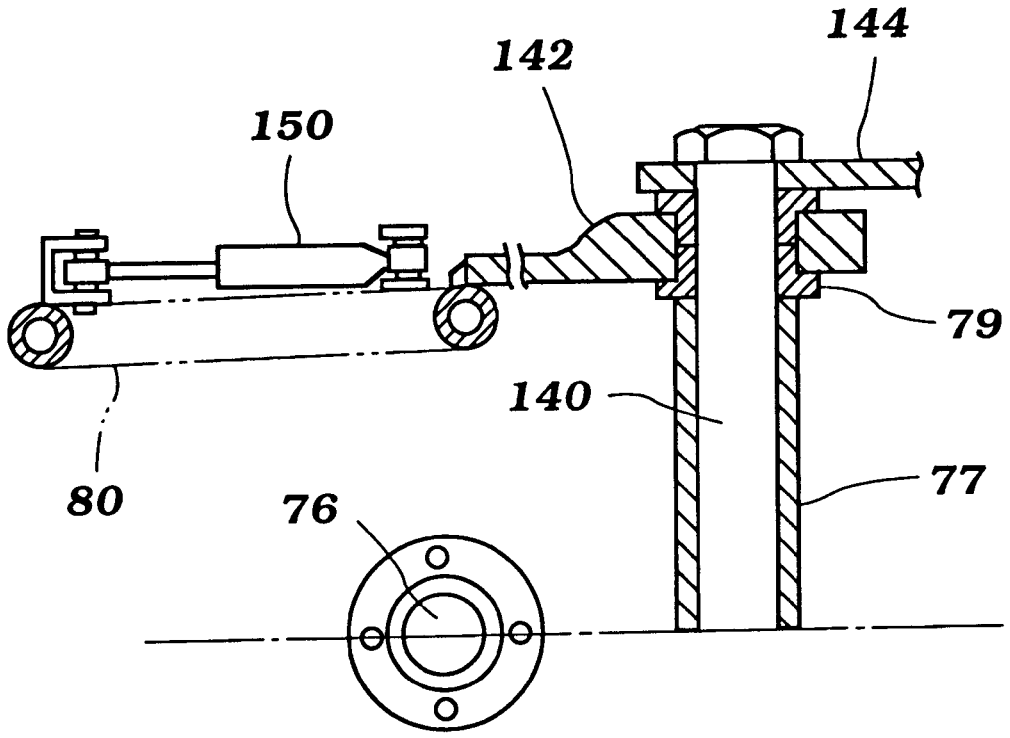
FIG. 13 is a partial top cross-sectional view of the charged-gas cylinder and frame support structure of FIG. 11.

As best shown in FIGS. 12 and 13, the watercraft incorporates a pair of conventional charged-gas cylinders or gas dampers 150, operating between the support frame 80*a* to the upper deck 16*a* of the watercraft. These cylinders 150 can, when fully extended, generate sufficient force to hold the frame 80*a* in an open and upright position.

Figure 14:
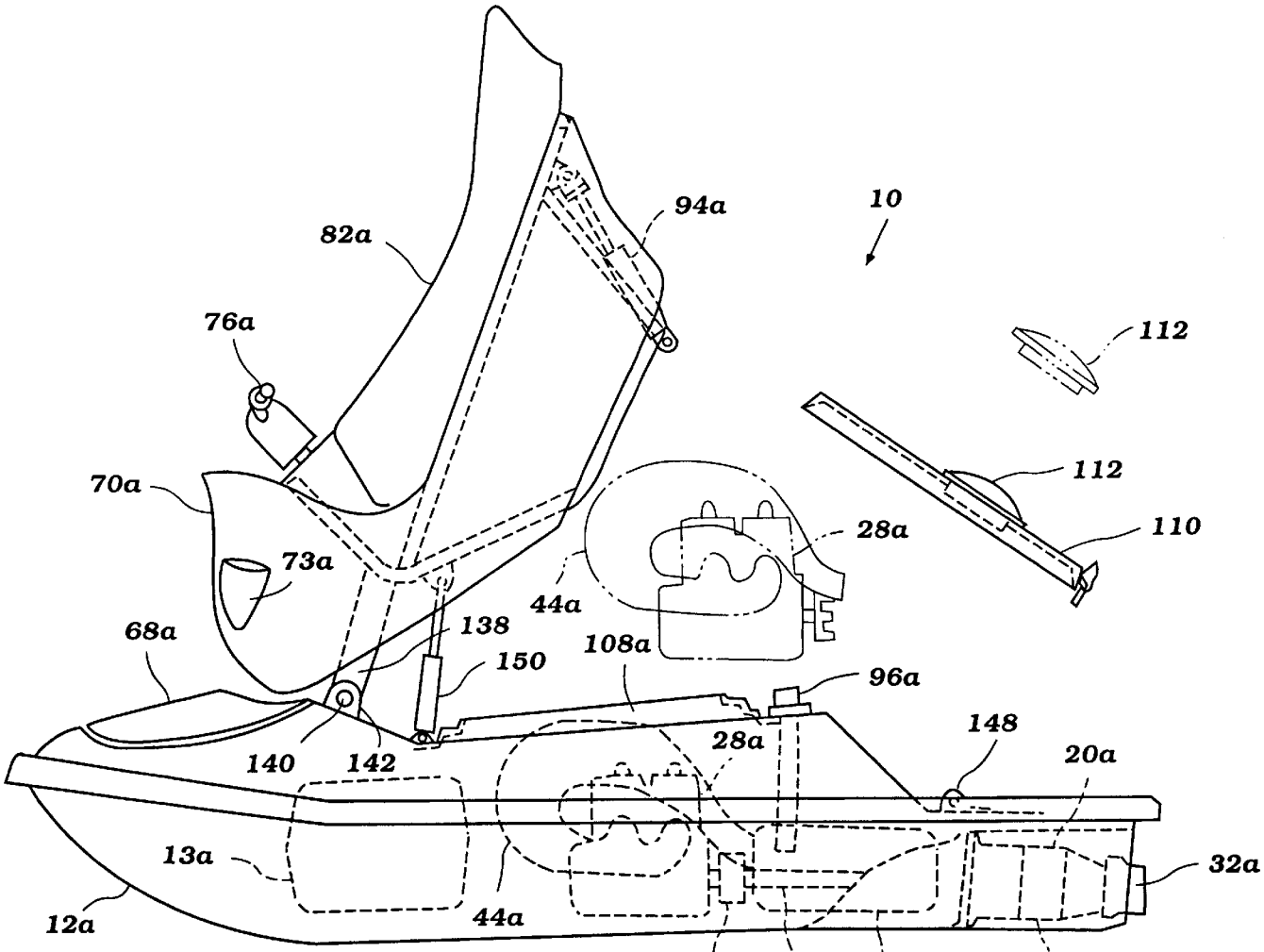
FIG. 14 is a partial sectional side view of the watercraft of FIG. 11, with the support frame and protective cowling rotated away from the engine cover.

With reference now to FIG. 14, in this embodiment the engine opening 108*a* may be conveniently accessed by detaching the quick-release coupling 148, and then rotating the rear section of the frame support 80*a* and associated components forward. As previously noted, the frame support and associated components are secured in the open and upright position by the pair of charged-gas cylinders 150 positioned between the frame 80*a* and the upper deck 16*a* of the watercraft.

Figure 15:
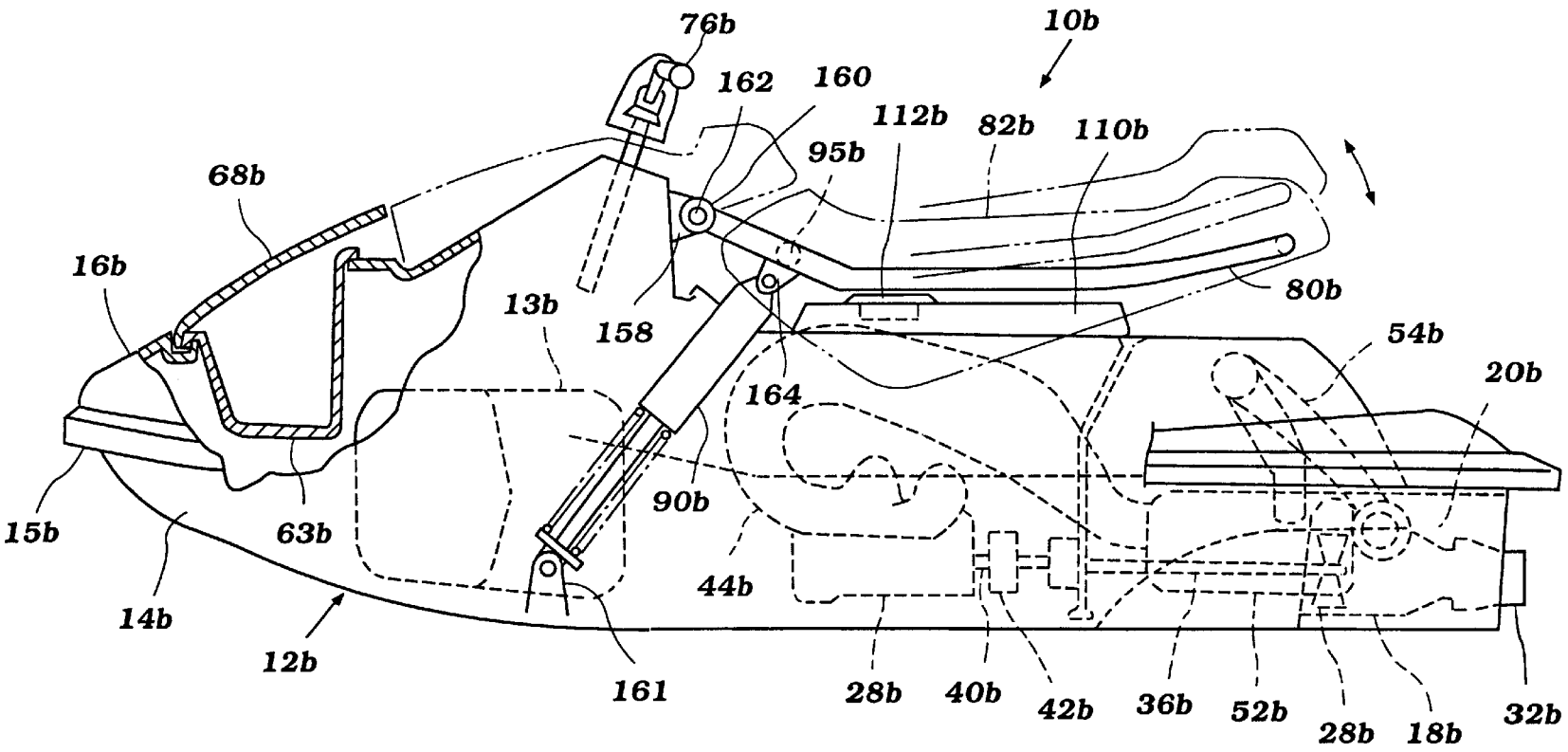
FIG. 15 is a partial sectional side elevational view of a personal watercraft including a cushioning apparatus configured in accordance with an alternate embodiment of the present invention.
Figure 16:
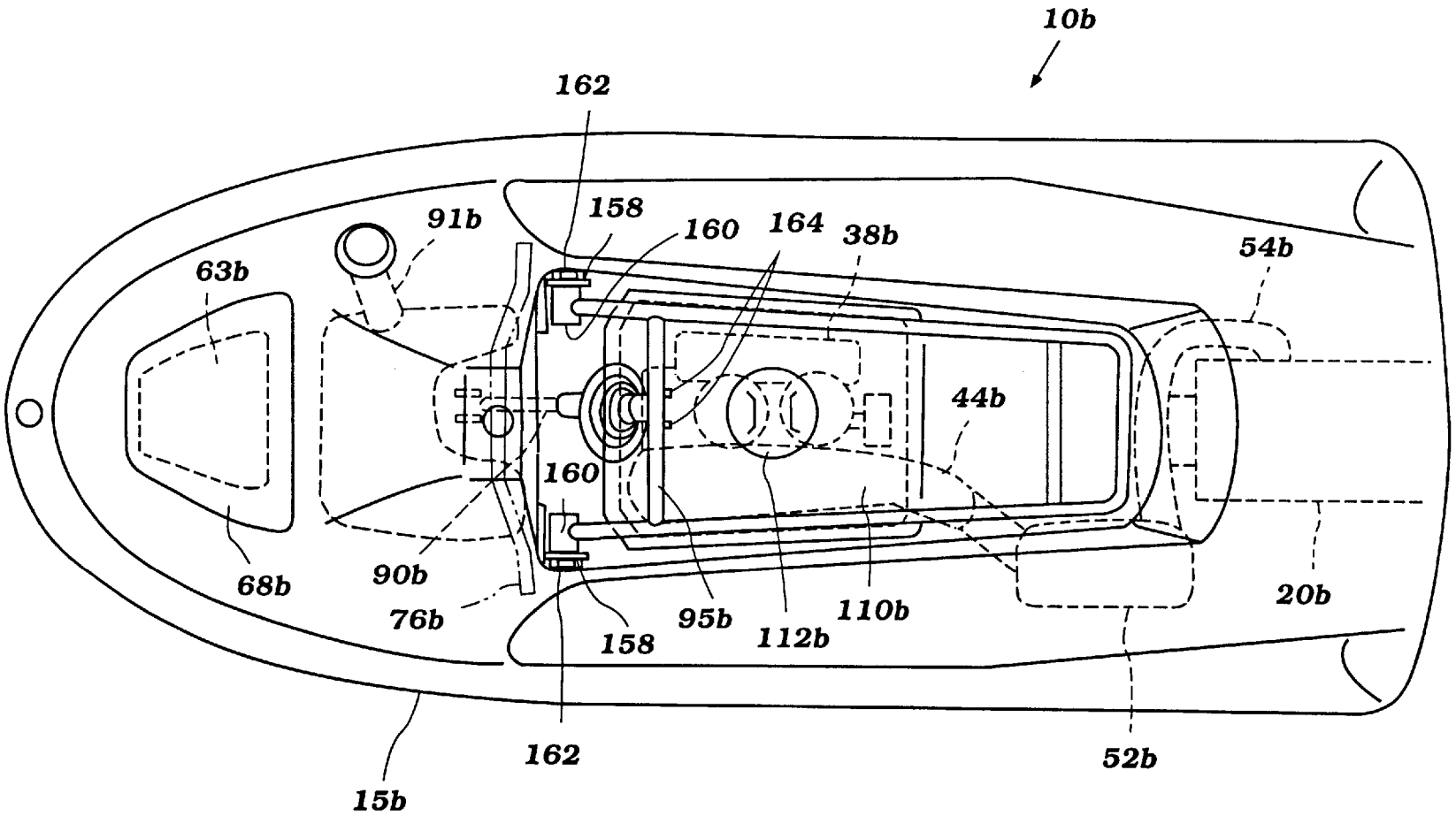
FIG. 16 is a top plan view of the watercraft of FIG. 15, with the rider seat and protective cowling removed.
Figure 17:
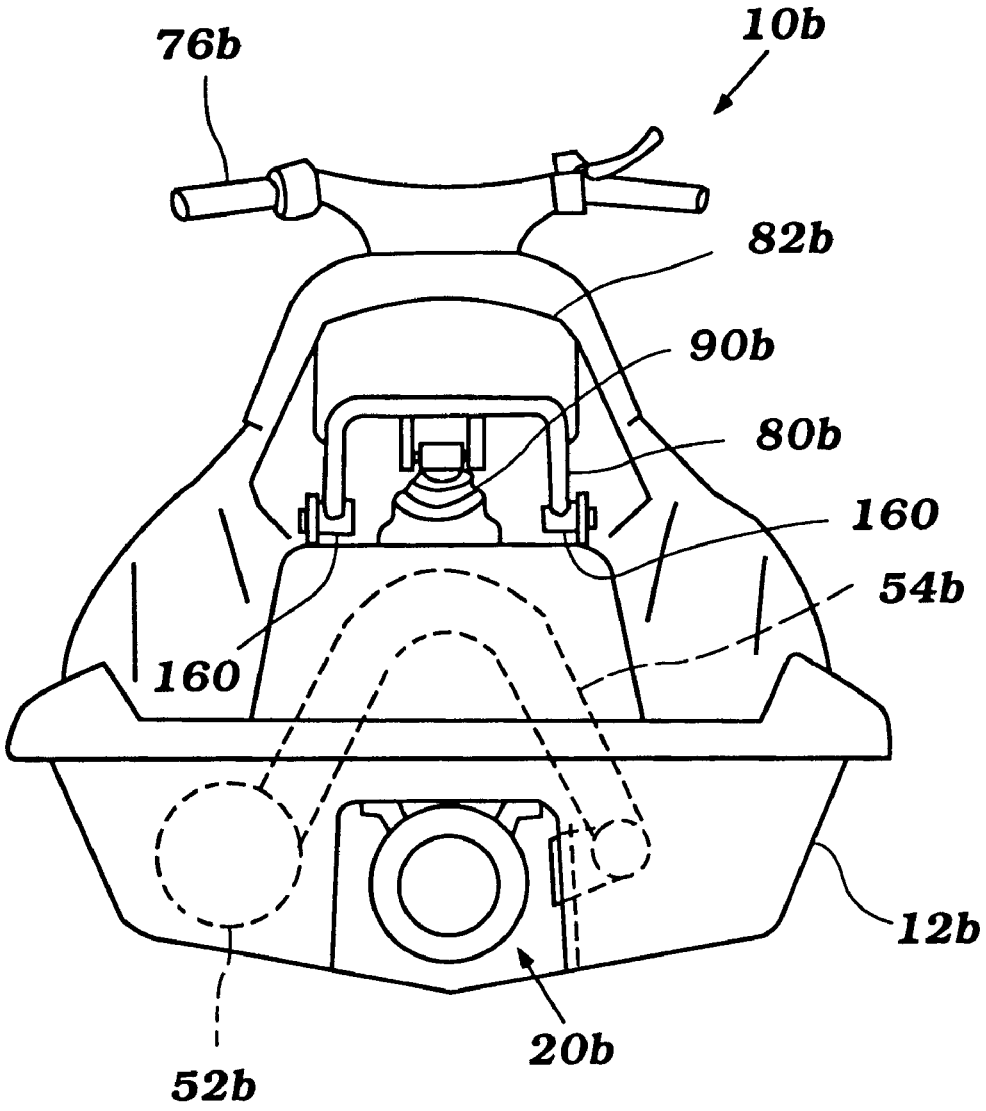
FIG. 17 is a rear elevated plan view of the watercraft of FIG. 15.
Figure 18:
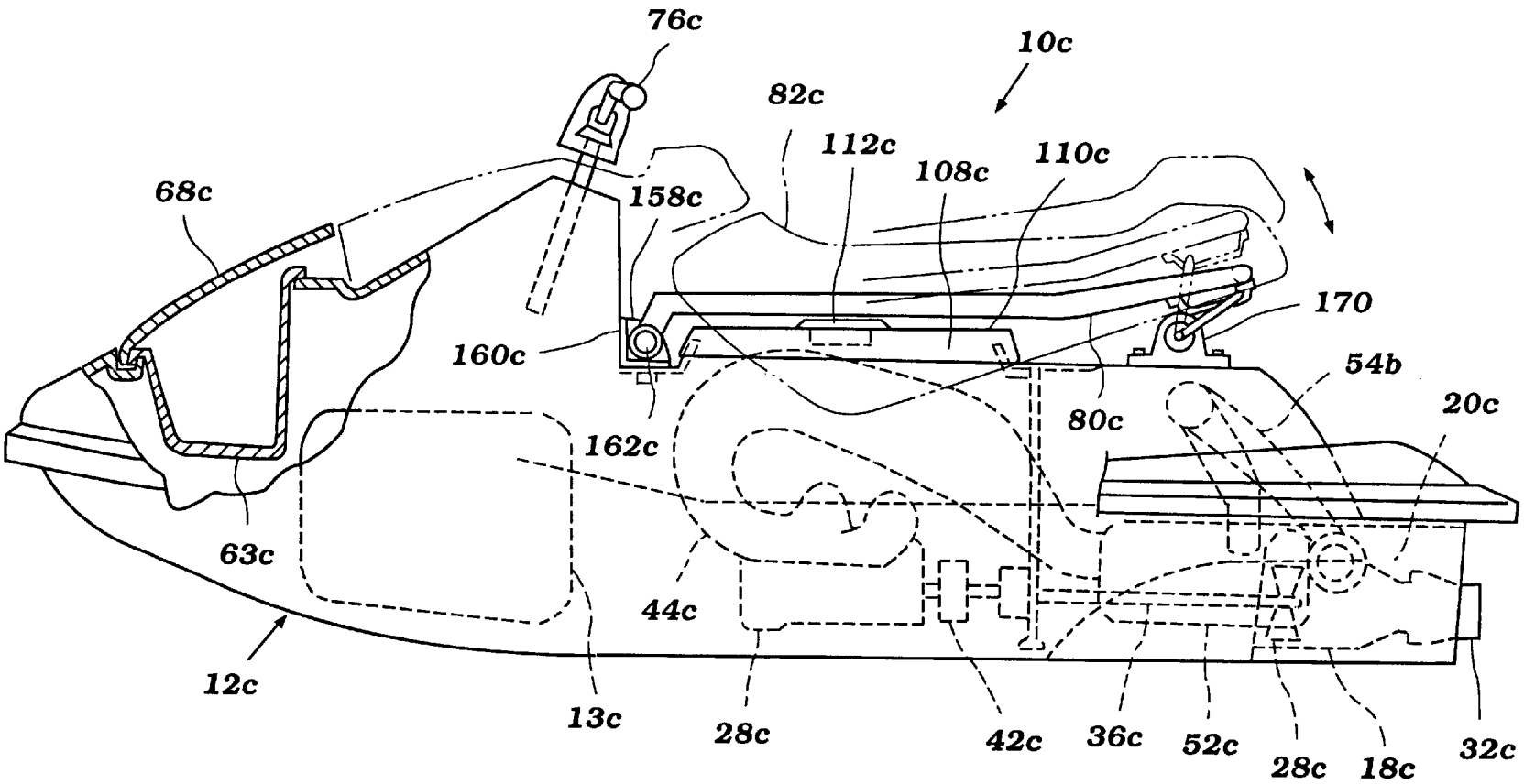
FIG. 18 is a partial sectional side elevational view of a personal watercraft including a cushioning apparatus configured in accordance with an alternate embodiment of the present invention.
Figure 19:
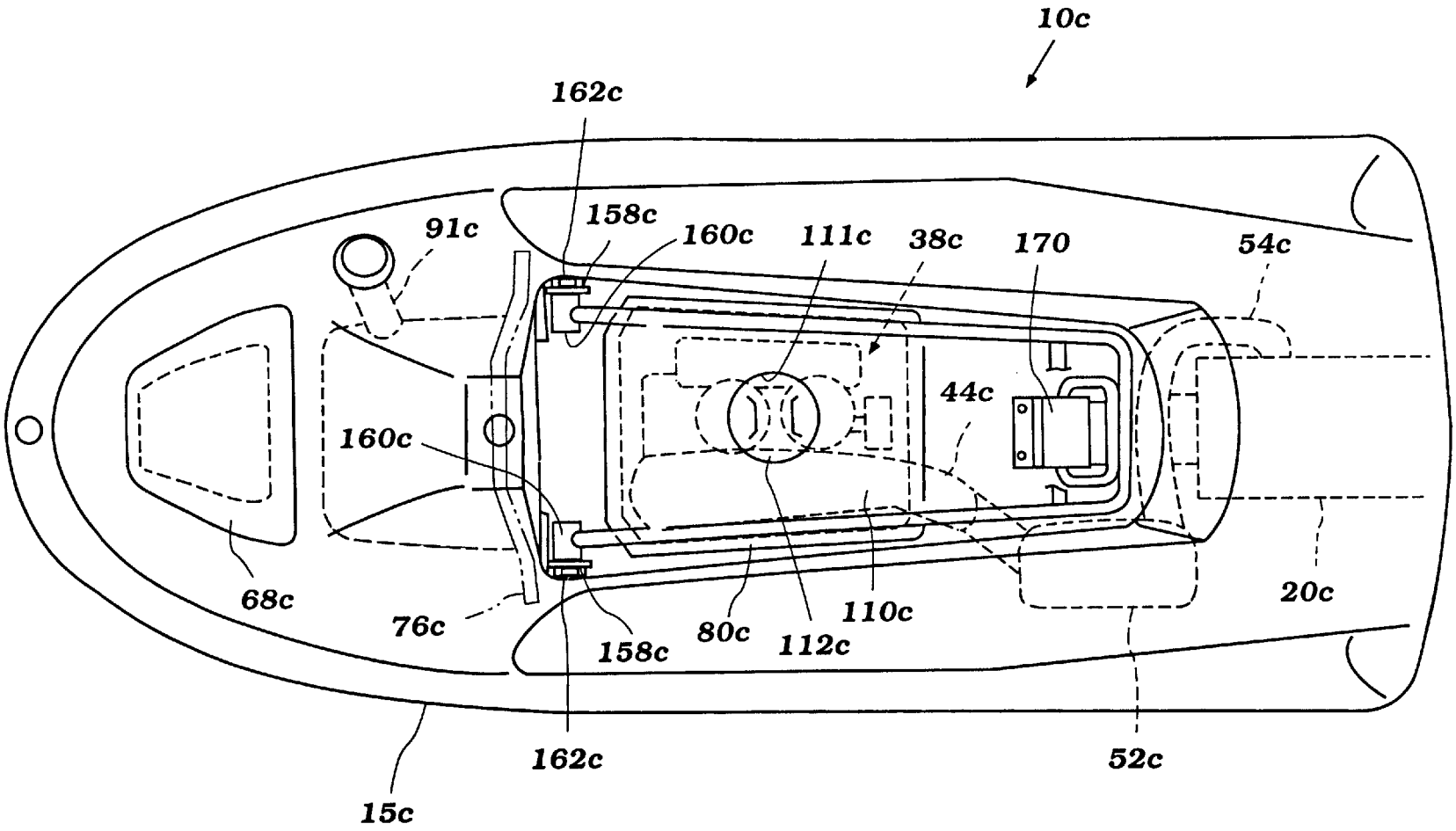
FIG. 19 is a top plan view of the watercraft of FIG. 18, with the rider seat and protective cowling removed.
Figure 20:
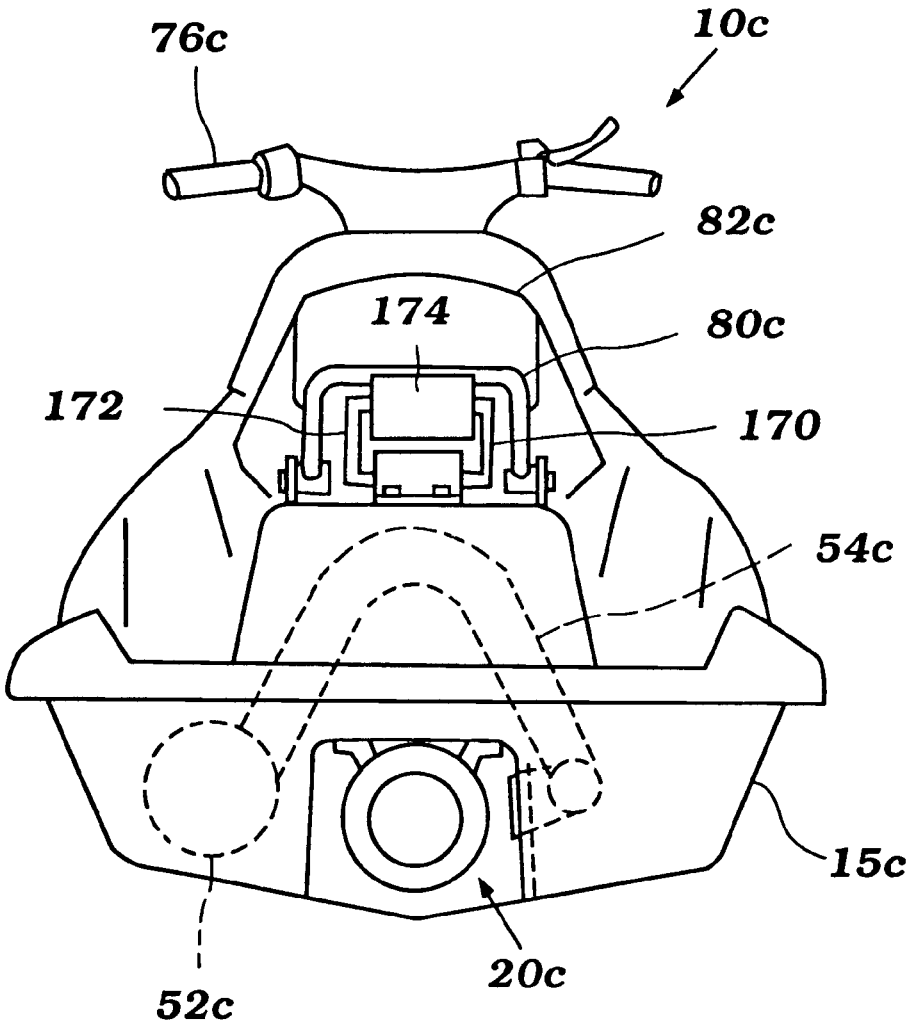
FIG. 20 is a rear elevated plan view of the watercraft of FIG. 18.

FIGS. 15–17 depict a watercraft constructed in accordance with an alternate embodiment of the present invention. A "b" suffix has been added to like reference numerals to indicate the similar components of this embodiment. In the illustrated embodiment, the forward edge of the support frame 80*b* terminates in two boss members 160, each boss member being rotatably secured to a bracket 158 by a bolt 162. The brackets 158 are mounted in the upper deck 16*b* of the watercraft hull 12*b*. The lower end of the single forward shock absorber 90*b* is rotatably secured to a bracket 161 on the inside of the lower hull 14*b*, and the upper end of the forward shock absorber 90*b* is rotatably secured to a bracket 164 on strut member 95*b* that forms part of the frame assembly. In this embodiment, the unsupported aft portion of the seat can move freely in the vertical direction while the front section of the seat, which is rotatably secured to the upper deck, is more limited in its range of vertical motion.

Desirably, one of the ends of the forward shock absorber 90*b* is attached to its corresponding bracket 161, 164 with a quick-release type coupling, which allows the shock absorber to be detached and the frame assembly to be quickly and conveniently lifted away to facilitate access to the engine opening and compartment. Because it is generally easier to gain access to the bracket 164 on strut member 95*b*, the upper end of the forward shock absorber will be typically so connected.

FIGS. 18–23 depict a watercraft constructed in accordance with another embodiment of the present invention. A "c" suffix has been added to like reference numerals to indicate the similar components of this embodiment. In this embodiment, the forward edge of the support frame 80*c* terminates in two boss members 160*c*, each boss member being rotatably secured to a bracket 158*c* by a bolt 162*c*. The brackets 158*c* are mounted to the upper deck 16*c* of the watercraft hull 12*c*. In this embodiment, the cushioning apparatus incorporates a torsional damper 170 positioned near the aft end of the seat 82*c*.

Figure 21:
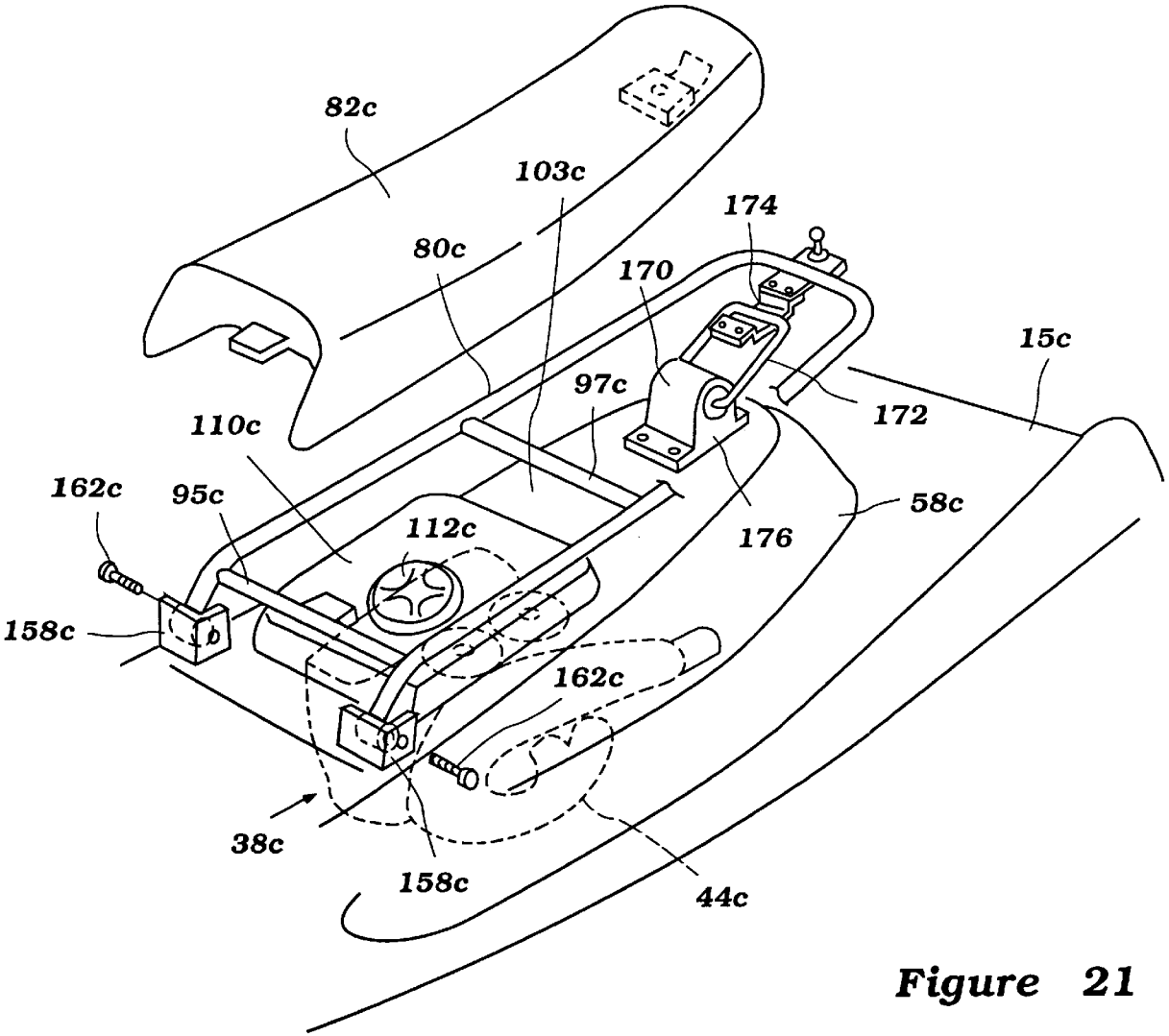
FIG. 21 is a partial perspective view of the cushioning apparatus of FIG. 18, with the rider seat exploded off the support frame.
Figure 22:
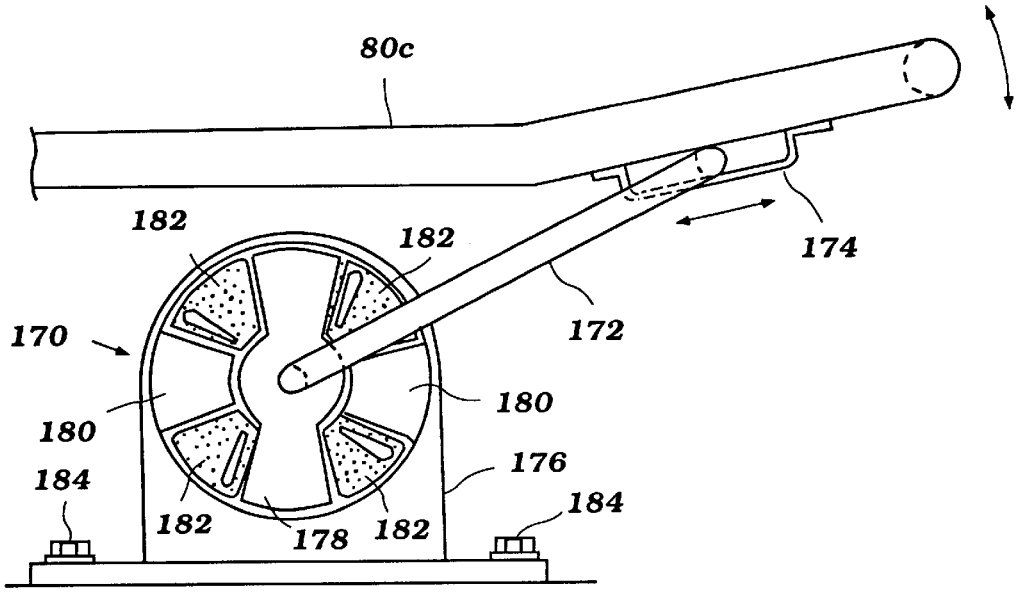
FIG. 22 is a cross-sectional view of the elastic spring mechanism of FIG. 18, showing the spring in a relaxed state.
Figure 23:
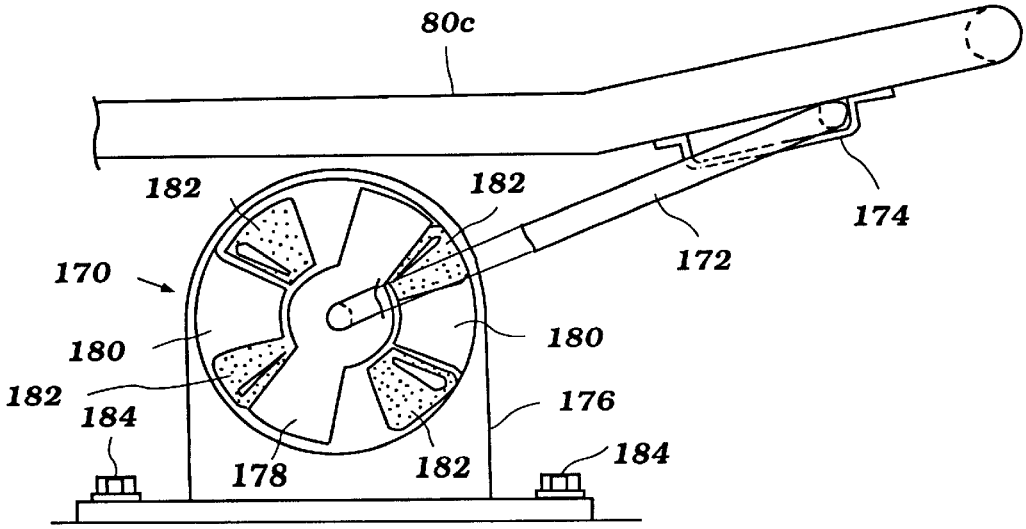
FIG. 23 is a cross-sectional view of the elastic spring mechanism of FIG. 18, showing the spring in a stressed state.

As can best be seen from FIGS. 21 and 22, the torsional damper 170 comprises an outer case 176 which is secured to the pedestal 58*c* by bolts 184. A pair of dividing walls 180 are attached to the inner walls of the outer case 176, and are fixed to resist rotation. An inner body 178 is positioned within the outer case 176, and is separated from the dividing walls 180 by a plurality of elastic buffers 182. An arm 172 is secured to the inner body 178, such that the inner body 178 rotates together with the arm 172. The opposite end of the arm 172 is positioned within a slider 174 which is fixed to the support frame 80*c* of the seat 82*c*.

During operation of the watercraft 10*c*, the hull 12*c* will experience impact forces which will be transmitted to the seat 82*c* of the watercraft. As the seat 82*c* depresses vertically, the arm 172 will be pushed downward. Concurrently, the downward rotation of the arm 172 will cause the end of the arm 172 positioned in the slider 174 to slide aft along the longitudinal axis of the watercraft, thus sliding further aft in the slider 174. Because the slider allows the arm to move along the longitudinal axis of the watercraft, this arrangement allows for some movement of the seat before the damper takes effect, thereby increasing the comfort of the ride.

The rotation of the arm 172 also rotates the inner body 178, which will compress the elastic buffers 182 against the dividing walls 180. The elastic buffers 182 will resist further compression, and further rotation of the arm 172. Accordingly, the arm will resist further depression of the seat 82*c*. When the seat 82*c* returns to its equilibrium position, the arm will rotate back to its normal position, thereby reducing or eliminating the compression force on the elastic buffers 182.

In this embodiment, while the seat 82*c* is secured to the support frame 80*c*, the arm 172 cannot be removed from the slider 174, thus securing the support frame 80*c* to the pedestal 58*c*. In order to detach the support frame 80*c* from the pedestal 58*c*, the seat 82*c* is detached from the support frame 80*c*, allowing the arm 172 to be rotated out and away from the slider 174. The support frame 80*c* can then be conveniently lifted and rotated away from the engine cover and opening.

Figure 24:
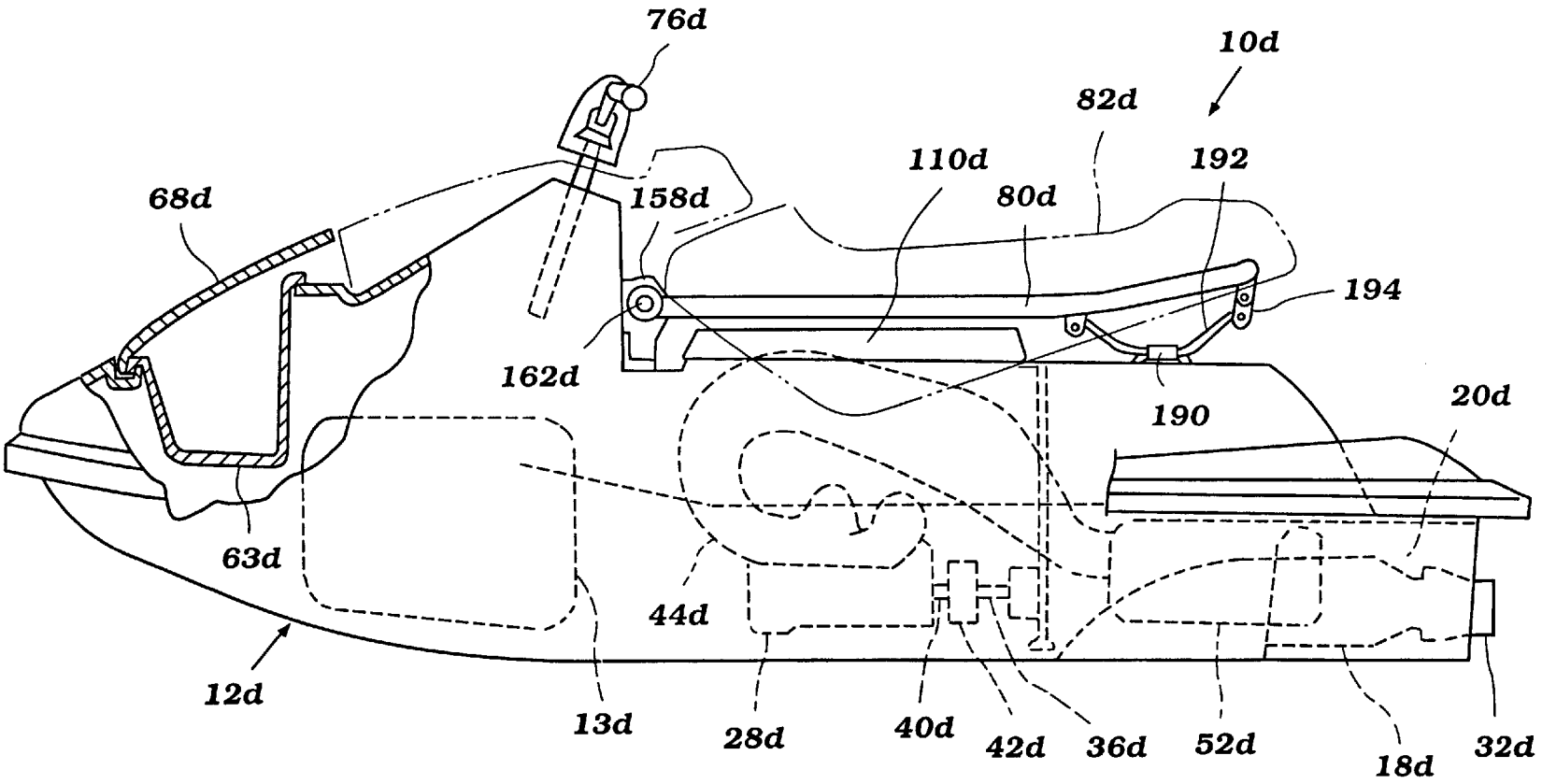
FIG. 24 is a partial sectional side elevational view of a personal watercraft including a cushioning apparatus configured in accordance with an alternate embodiment of the present invention.
Figure 25:
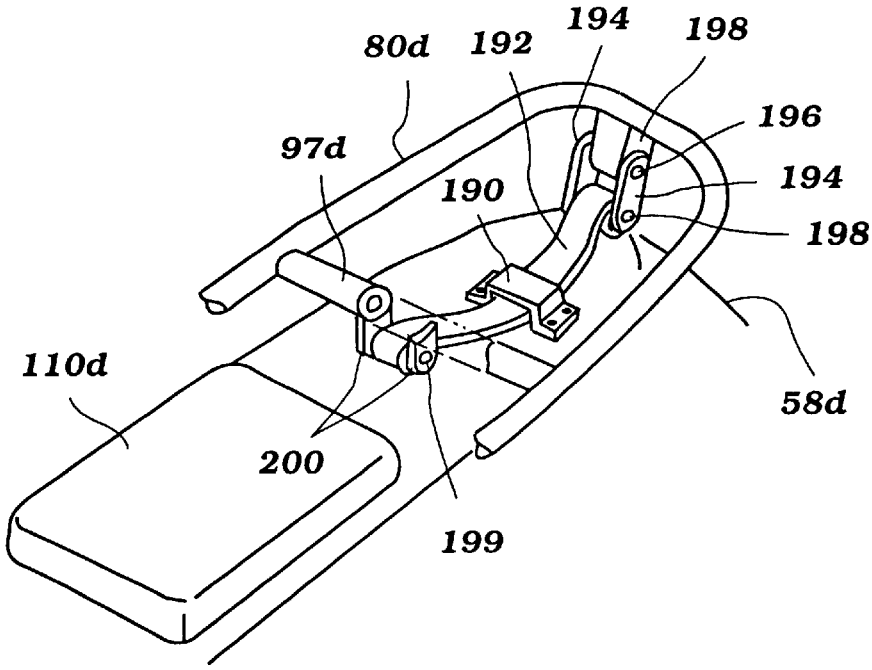
FIG. 25 is a partial perspective view of the cushioning apparatus of FIG. 24, with the rider seat removed.
Figure 26:
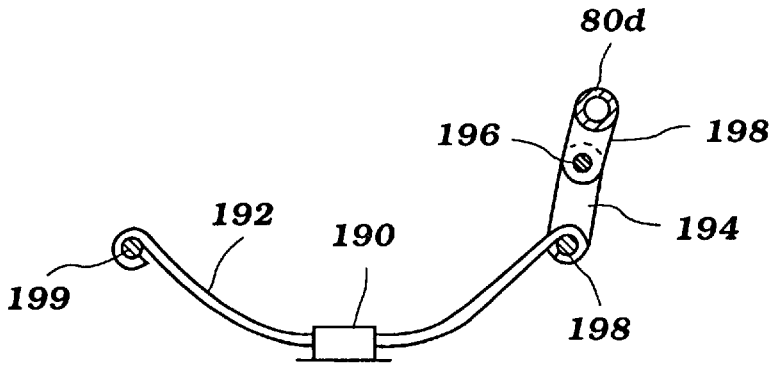
FIG. 26 is a side elevational view of the leaf spring apparatus of FIG. 24.
Figure 27:
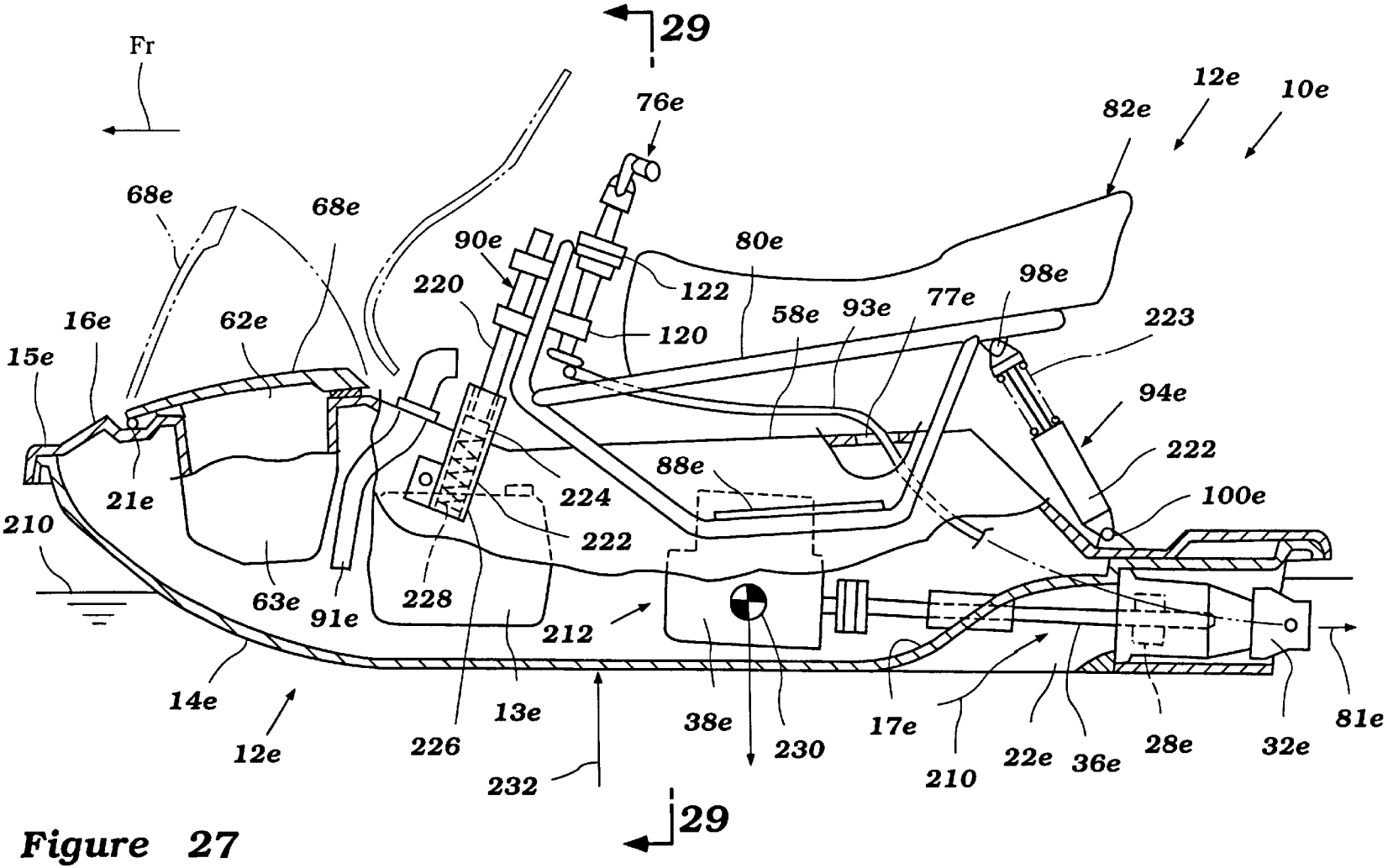
FIG. 27 is a partial sectional side elevational view of a personal watercraft including a cushioning apparatus configured in accordance with an alternate embodiment of the present invention.
Figure 28:
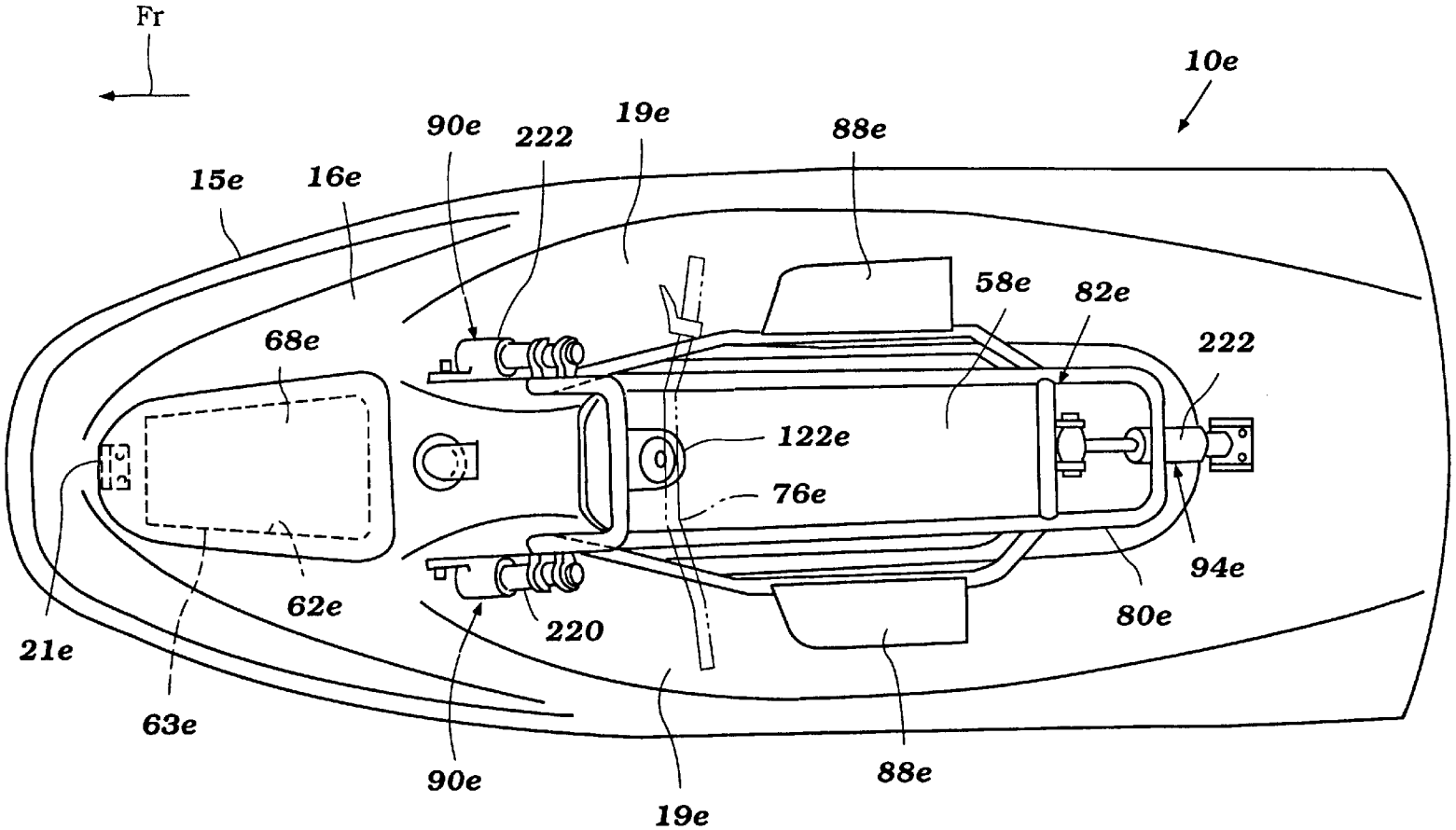
FIG. 28 is a top plan view of the watercraft of FIG. 27, with the rider seat and protective cowling removed.
Figure 29:
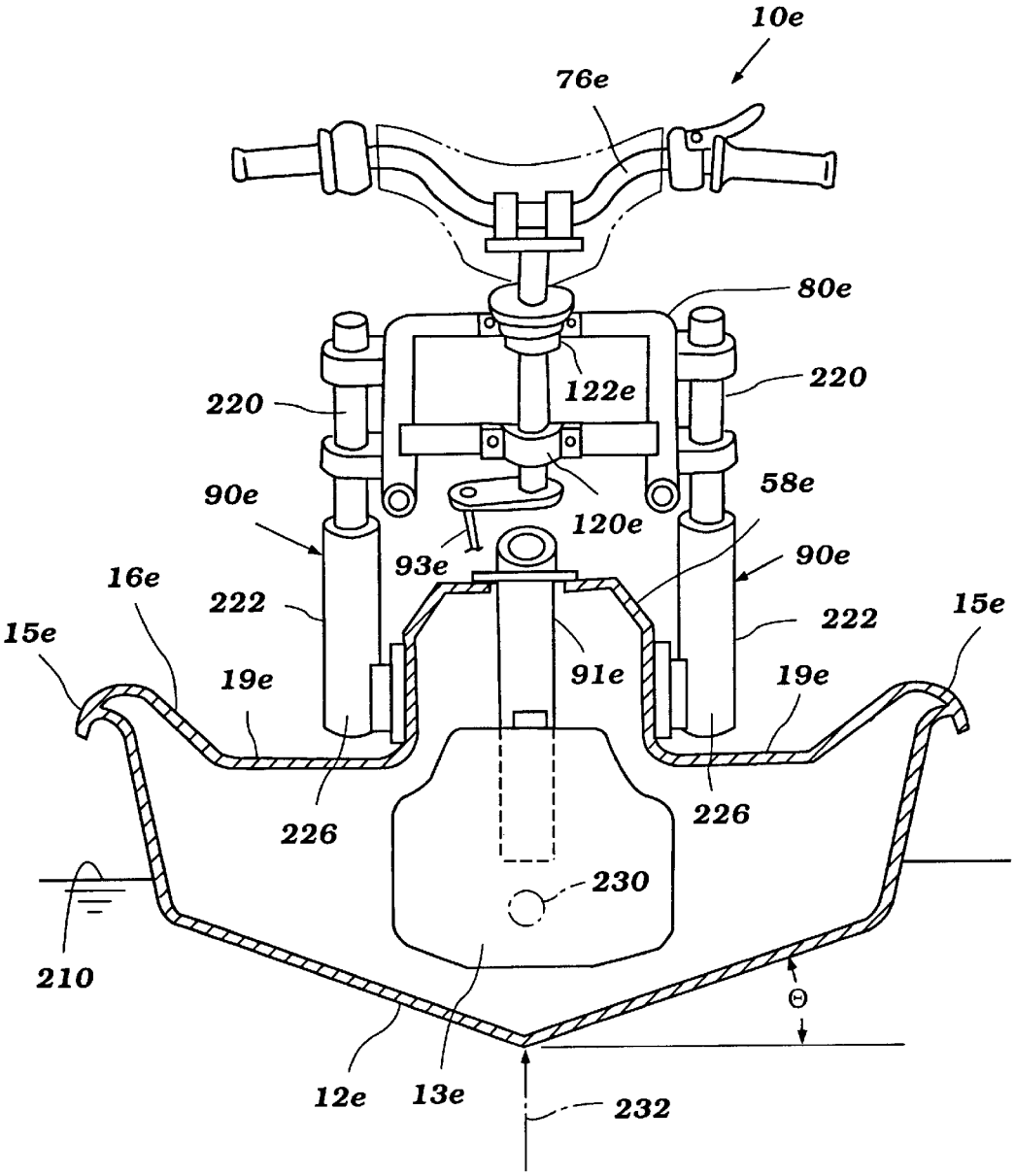
FIG. 29 is a sectional view of the watercraft of FIG. 27, taken along line 29—29.

FIGS. 24–26 depict a watercraft constructed in accordance with an additional embodiment of the present invention. A "d" suffix has been added to like reference numerals to indicate the similar components of this embodiment. In this embodiment, the forward edge of the support frame 80*d* terminates in two boss members 160*d*, each boss member being rotatably secured to a bracket 158*d* by a bolt 162*d*. The brackets 158*d* are mounted in the upper deck 16*d* of the watercraft hull 12*d*. In this embodiment, the cushioning apparatus incorporates a leaf spring 192 which provides the cushioning force near the aft end of the seat 82*d*.

As can best be seen from FIG. 25, the cushioning assembly comprises a semi-elliptical spring 192 positioned below the aft end of the support frame assembly 80*d*. The lower end of the leaf spring 192 is secured to the pedestal 58*d* of the watercraft 10*d* by a bracket or press member 190. The forward end of the spring 192 is rotatably secured to a pair of brackets 200 on strut member 97*d* of the support frame 80*d* by a shaft 199. The aft end of the spring 192 is rotatably secured to a bracket 198 of the support frame 80*d* by parallel link arms 194 and shafts 196, 198. The link arms permit the spring 192 to expand and contract in the longitudinal direction in response to stress on the spring 192 in a manner well known to those of ordinary skill in the art.

FIGS. 27–30 depict a watercraft of similar construction to the watercraft of FIG. 1, with the forward and rear support structures being positioned to maximize the comfort of the rider during even very rough water conditions and/or high speed transits. An "e" suffix has been added to like reference numerals to indicate the similar components of this embodiment. In the arrangement of this cushioning apparatus, each shock absorber 90*e*, 94*e* includes a piston 224 that slides within a cylinder 222. The piston 224 acts against a compression spring 228 that lies between the piston 224 and a lower end of the cylinder 226. The spring 228 desirably is attached to both the lower end of the cylinder 226 and the underside of the piston 224 in order to dampen movement of the shock absorber in both upward and downward directions. In addition, or in the alternative, the shock absorber can include other damping means, such as, for example, a second spring 223 located between the piston and an upper end of the cylinder and/or a fluid (e.g., air or hydraulic fluid) that passes between a pair of chambers upon movement of the piston, as known in the art.

An actuator rod 220 extends through a hole formed at an upper end of the cylinder 222 of each shock absorber 90*e*, 94*e*. The lower end is fixed to the piston 224. The rod 220 slides through the cylinder's upper hole upon movement of the piston 224 within the cylinder 222 in a manner well known in the art.

Figure 30:
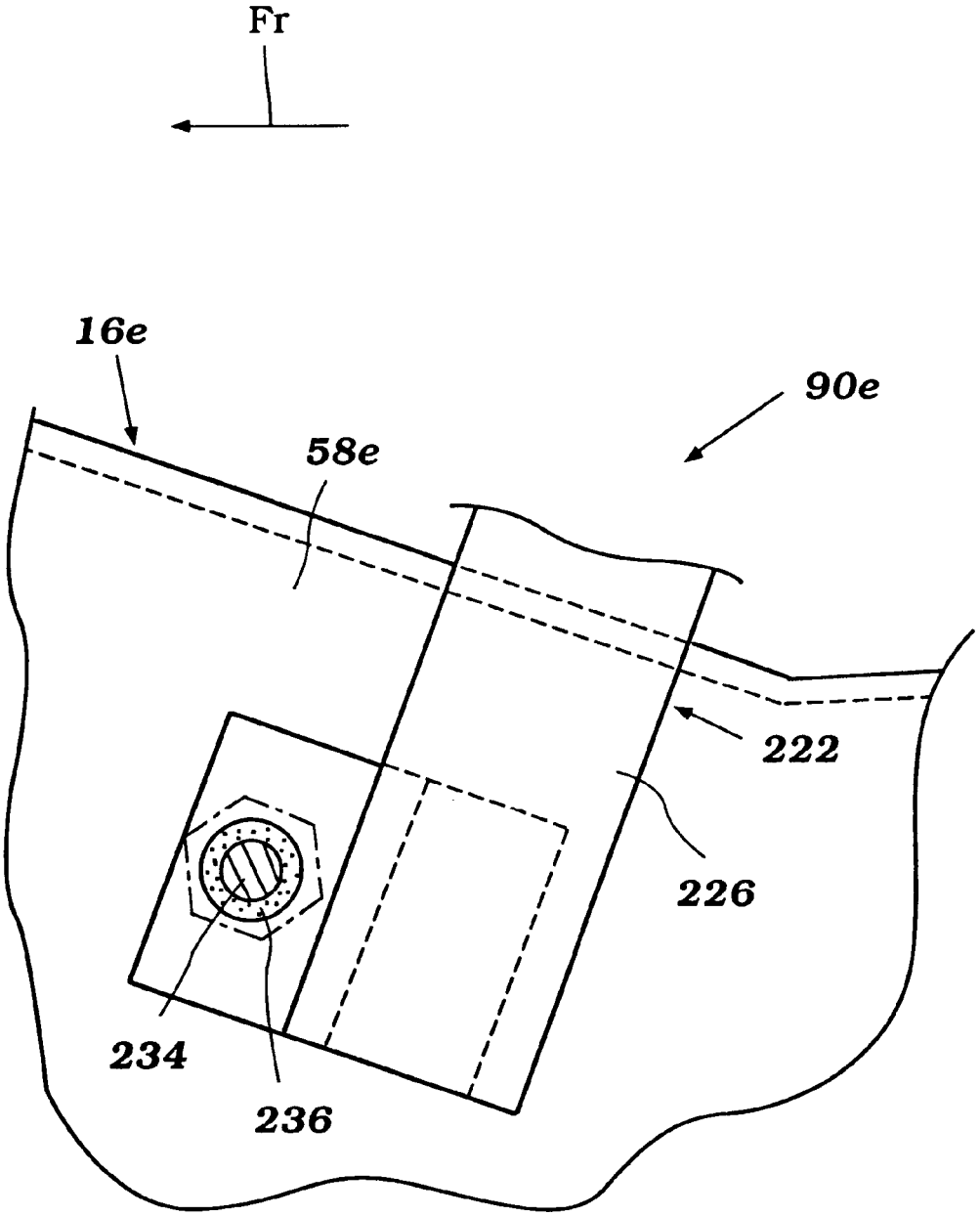
FIG. 30 is a partial side view of the connection between a forward shock absorber and the upper deck of FIG. 27.

As best shown in FIG. 30, the lower end of the cylinder 226 is bolted to a fixture 234 on the upper deck 16*e*. A vibration damper 236, constructed of a flexible material such as rubber or soft plastic, is used to isolate the cylinder 226 from minor vibrations in the hull of the watercraft 10*e*. The damper 236 in the illustrated embodiment is located between the cylinder 226 and the fixture 234.

With reference to FIGS. 27–32, the watercraft 10*e* has a center of gravity 230 acting downward which typically, but not necessarily, coincides with the location of the engine 38*e* in the watercraft hull. Similarly, water 210 underneath the watercraft hull creates a buoyant force 232 acting upwards on the watercraft. Where these two forces are equal in magnitude, and their respective lines of action coincide, the watercraft reaches a state of equilibrium.

In this embodiment, it can be seen that the forward shock absorbers 90*e* and the rear shock absorber 94*e* are spaced on either side of the longitudinal center point of the engine and also are spaced on either side of the center of gravity of the watercraft. In the illustrated embodiment the forward and rear shock absorbers 90*e*, 94*e* are equidistant from the center of the engine and/or from the center of gravity 230 of the watercraft 10*e*. Because forces acting on the hull of the watercraft 10*e* tend to rotate the watercraft 10*e* around its center of gravity 230, this positioning of the support structure allows the force to act equally on the forward and rear shock absorbers 90*e* and 94*e*, thus allowing a central portion of the seat to experience less moment while the suspension devices absorb the maximum force with a minimum transference of momentum to the support, seat and rider. In contrast, a suspension system that does not equally support the seat about the center of gravity will experience disproportionate loads on the forward and rear shock absorbing systems, which results in increased vertical and longitudinal displacement of the seat. Accordingly, the present embodiment provides a smoother ride for the operator and passenger(s) of the watercraft.

Figure 31:
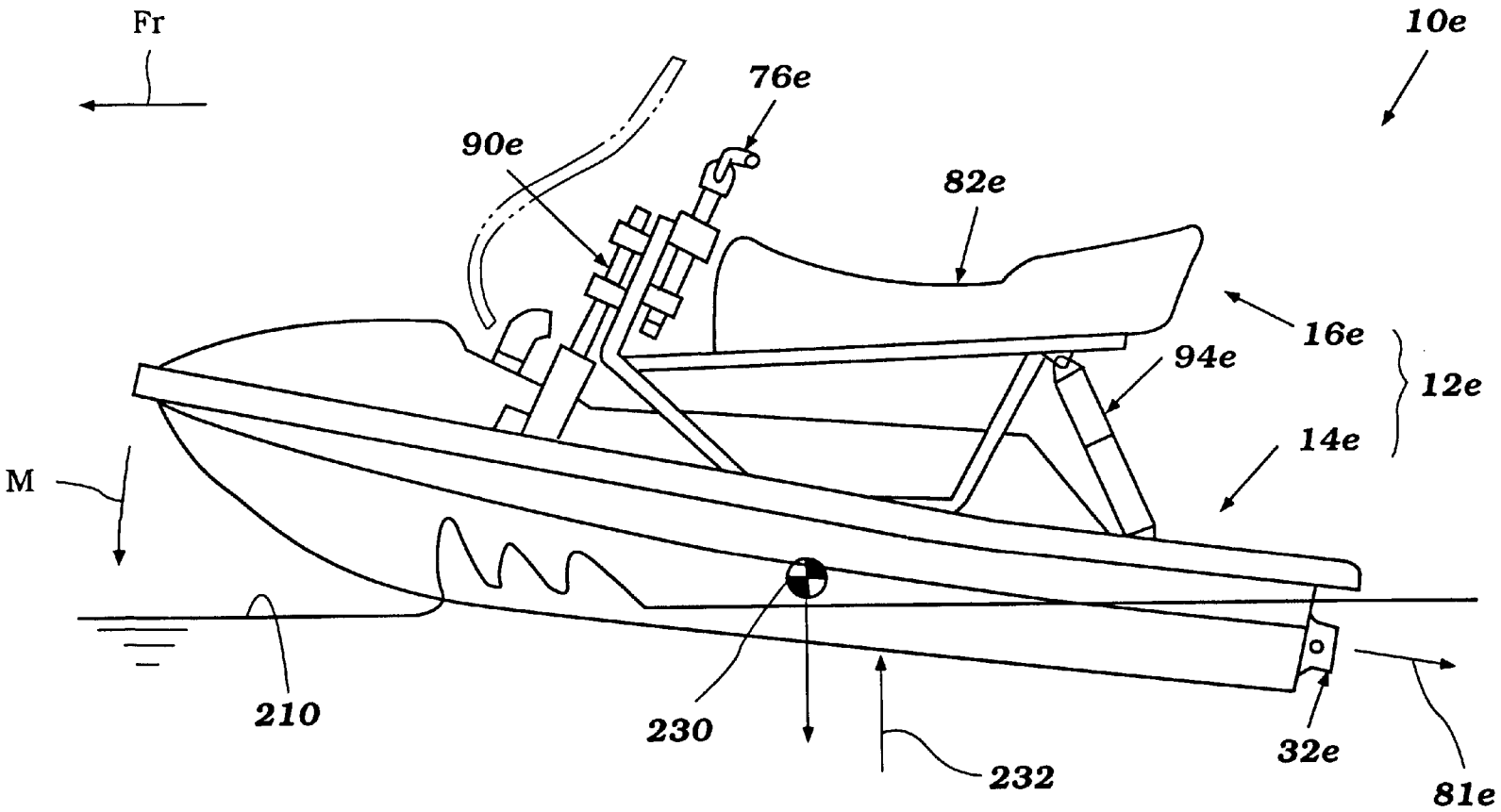
FIG. 31 is a elevated side view of the watercraft of FIG. 27, showing the center of gravity and center of buoyancy of the watercraft while operating a low speeds.
Figure 32:
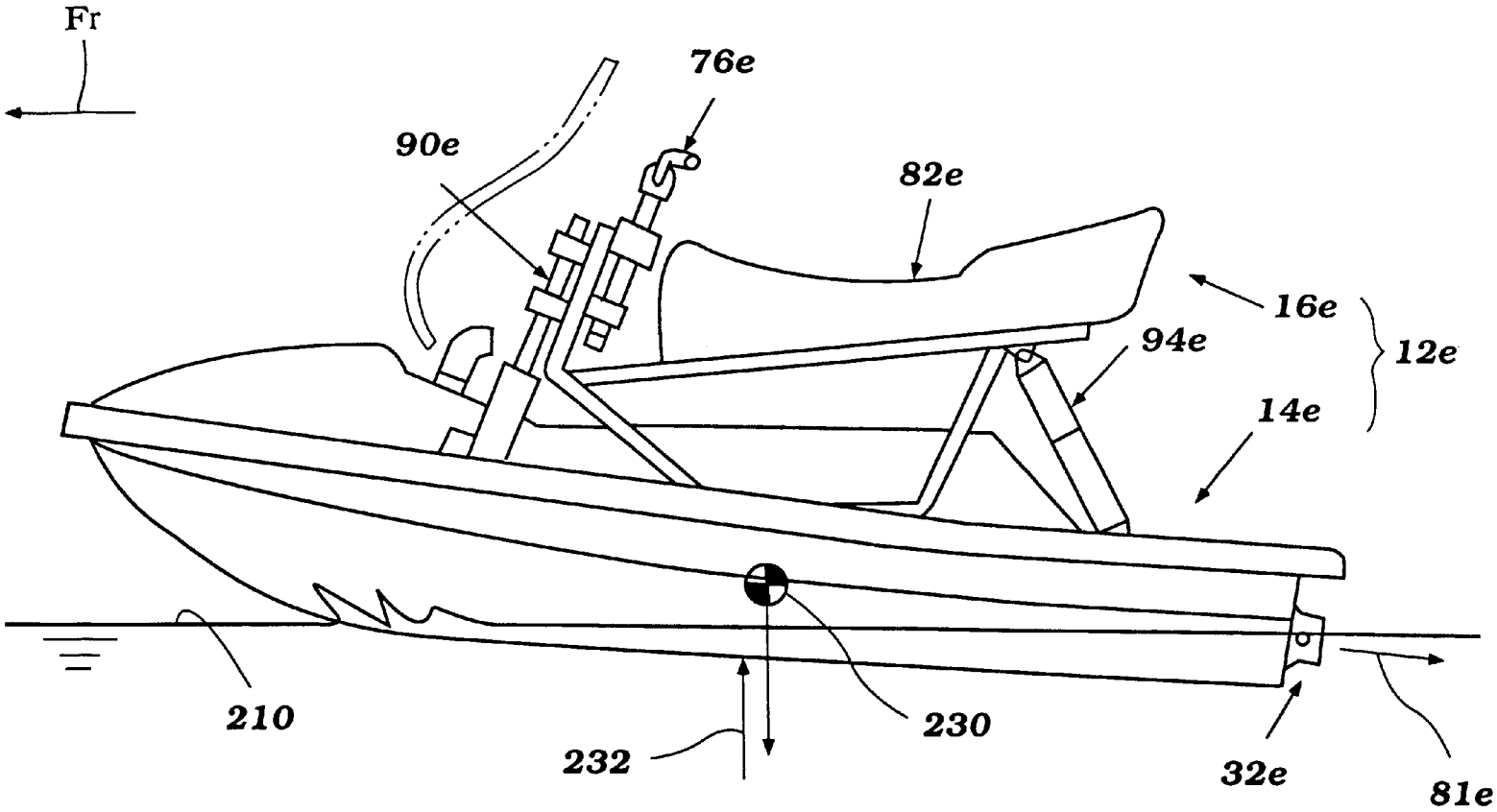
FIG. 32 is a elevated side view of the watercraft of FIG. 27, showing the center of gravity and center of buoyancy of the watercraft while operating a high speeds.

The arrangement of the suspension system on either side of the center of gravity and/or the center of the engine reduces watercraft "porpoising" as well as improves the acceleration characteristics of the watercraft. Although it is previously known that an increase in the hull angle θ, as shown in FIG. 26, will increase the stability of the watercraft while traveling in the forward direction Fr, an increase in this hull angle also causes an attendant increase in the porpoising of the watercraft, and may cause uncomfortable vertical motions to the rider. Furthermore, when the watercraft transits from low speed operation to a "hump" position as shown in FIG. 31, a significant amount of the watercraft forward hull section is lifted out of the water, which can allow air to be sucked into the water passage and thereby reduce the propulsive force generated by the watercraft. If this happens, the watercraft may not be able to shift from the hump position to the planing position depicted in FIG. 32. A similar problem can also occur when the weight load of the watercraft is heavy, which will further depress the rear of the watercraft, thereby increasing the difficulty for the watercraft to transition to the hump and/or planing positions. The arrangement of the suspension system disclosed in FIG. 27 generally moves the rider(s) closer to the center of gravity of the watercraft to obviate these problems. The forward and rear shock absorbers desirably have different spring constants and travel (i.e., movement between the seat and the hull) to improve the feel of the watercraft. The spring constants of the forward shock absorbers desirably are greater than the spring constant of the rear shock absorber, resulting in the forward shock absorbers depressing less (i.e., have less travel) than the rear shock absorber for a given impact. These relative stiffnesses and travel provide a feel of stable and solid steering control and handling while providing a soft ride. Because the rear shock absorber has a lower spring constant with greater travel, it tends to deflect more for a given impact than the front shock absorbers. This results in the rear shock absorber absorbing a greater proportion of the impact force than the front shock absorber, increasing the comfort of the ride without reducing the feel of stiff control.

As common to each of the embodiments described above, a cushioning apparatus is provided on the watercraft in order to absorb a portion of any impact forces applied to the hull during riding. The cushioning apparatus thus reduces rider fatigue while softening the effects of abrupt turns and jumps.

The above described position of the suspension system relative to the engine and/or to the center of gravity of the watercraft can of course be incorporated into the other above-described embodiments of a watercraft with a suspension system. Other features, such as the just-described relative stiffness and travel of the cushioning elements (e.g., the shock absorbers), can also be incorporated into many of the above-described embodiments (e.g., the watercraft depicted in FIGS. 1–14). One skilled in the art thus will realize that features of one embodiment can be used with another embodiment. For instance, the gas-charged cylinders can be used to hold the frame and/or seat of many of the embodiments in a raised position in addition to the embodiment in connection with which the cylinders are described. Likewise, the feet support and the cowling can be used with other embodiments. Thus, it should be understood that various features of several of the described embodiments can be combined while still embodying the present invention.

In addition, although this invention has been described in terms of certain preferred embodiments, other embodiments apparent to those of ordinary skill in the art are also within the scope of this invention. Accordingly, the scope of the invention is intended to be defined only by the claims that follow.

What is claimed is:

1. A small watercraft comprising a hull defining an engine compartment beneath at least a portion of an upper deck, an internal combustion engine housed within the engine compartment and driving a propulsion device to propel the watercraft, the engine including a plurality of cylinders, a rider's area including a seat located over at least one cylinder of the engine and supported by suspension system that operates between the seat and the hull so as to absorb a portion of an impact force applied to the hull of said watercraft, the hull including an access opening located at least in part beneath the seat that opens into the engine compartment, and a cover removably positioned over the access opening.

2. A small watercraft as in claim 1, wherein the seat is elongated and is supported by a front support and a rear support, one of the supports being compressible, and the access opening being arranged between the front and rear supports.

3. A small watercraft as in claim 1 additionally comprising a steering operator coupled to a steering column, the steering operator being rotatable about a steering axis.

4. A small watercraft as in claim 3, wherein said suspension system comprises a forward support and a rearward support, said forward support comprising two shock absorbers positioned on either side of the steering operator, and said rearward support comprising at least one shock absorber positioned aft of said engine opening.

5. A small watercraft as in claim 4, wherein said forward support is secured to said upper deck by one or more quick-release couplings, and said rearward support is pivotally secured to said upper deck, whereby when said quick-release couplings are released, a forward end of said seat can be lifted and rotated away from said upper deck, thereby exposing said opening.

6. A small watercraft as in claim 4, wherein said forward support is pivotally secured to said upper deck, and said rearward support is secured to said upper deck by one or more quick-release couplings, whereby when said quick-release couplings are released, a rear end of said seat can be lifted and rotated away from said upper deck, thereby exposing said opening.

7. A small watercraft as in claim 1 additionally comprising a quick-access opening formed in said cover, said quick-access opening being smaller than said access opening, and a quick-access cover closing the quick-access opening.

8. A small watercraft as in claim 1, wherein said access opening is large enough through which to pass the engine.

9. A small watercraft as in claim 1, wherein said suspension system comprises one or more shock absorbers located in a space between the bottom of said seat and the top of an upper deck portion of the hull.

10. A small watercraft as in claim 9, wherein said suspension system comprises two shock absorbers mounted in the top of said upper deck portion and the bottom of said seat.

11. A small watercraft as in claim 1, wherein said suspension system comprises a gas damper provided between said seat and said upper deck portion.

12. A small watercraft as in claim 1, further comprising a frame assembly supporting said seat, said frame assembly being connected to said suspension system.

13. A small watercraft as in claim 12, wherein said suspension system comprises a pair of shock absorbers positioned on either side of a steering operator.

14. A small watercraft as in claim 13, wherein said steering operator is secured to said frame assembly.

15. A small watercraft as in claim 14, wherein a shock absorber supports the steering operator on the frame assembly.

16. A small watercraft as in claim 12, wherein a forward part of said frame assembly is pivotally connected to said upper deck.

17. A small watercraft as in claim 16 additionally comprising a charged gas cylinder rotatably connected to said frame assembly and to said upper deck, whereby when said frame is rotated away from the upper deck, said charged gas cylinder supports the weight of said frame assembly.

18. A small watercraft comprising a hull defining an engine compartment at least partially beneath an upper deck, an engine housed within the engine compartment and including a plurality of cylinders, a seat extending in a longitudinal direction behind a steering operator, said seat being supported by a suspension system with at least a portion of said seat being movable in a vertical direction, the engine being located within the engine compartment and at least one cylinder of the engine is located beneath the seat, said suspension system being located at least in part in a space between said seat and said upper deck, a cushioning element of the suspension system being longitudinally positioned forward of said engine, and an opening formed in an upper deck below said seat, said opening being covered by an engine cover that can be opened or closed.

19. A small watercraft as in claim 18, wherein a forward portion of said seat is pivotally secured to said hull.

20. A small watercraft comprising a seat extending in a longitudinal direction behind a steering operator, said seat being supported by at least one cushioning member with at least a portion of said seat being movable in a vertical direction, an engine located inside a hull of the watercraft and including a plurality of cylinders, said seat located over at least one cylinder of the engine, said at least one cushioning member being located in a space between said seat and said hull and being longitudinally positioned rearward of said engine, and an opening formed in an upper part of said hull below said seat, said opening being covered by an engine cover that can be opened or closed.

21. A small watercraft as in claim 20, wherein said cushioning member comprises an elastic member which deforms in response to a force applied to said hull.

22. A small watercraft as in claim 21, wherein said cushioning member further comprises a spring arm secured to said elastic member, whereby said spring arm transfers a force from said elastic member to said seat.

23. A small watercraft as in claim 20, wherein said cushioning member comprises a leaf spring arm located in a space between said seat and said ship body.

24. A small watercraft comprising a seat extending in a longitudinal direction behind a steering operator, said seat and said steering operator being supported by a support frame movable in a vertical direction, said support frame being supported above an upper deck of said watercraft by one or more cushioning members, an engine opening formed in said upper deck under said seat, said engine opening being covered by an engine cover that can be freely opened and closed, and a support opening formed in said support frame located above said engine opening, such that said engine opening may be accessed through said support opening.

25. A small watercraft having a seat extending in a longitudinal direction behind a steering operator, said seat comprising a support frame movable in a vertical direction, said support frame being supported above an upper deck of said watercraft by one or more cushioning members, an engine opening formed in said upper deck under said seat, said engine opening being covered by an engine cover that can be freely opened and closed, and a support opening formed in said support frame located above said engine opening, such that said engine opening may be accessed through said support opening.

26. A small watercraft as in claim 25, wherein said support frame comprises a pair of frame members, and said support opening is located between said frame members.

27. A small watercraft as in claim 25, wherein said support frame further comprises a pair of foot supports, positioned along opposite sides of said seat, said foot supports being movable in a vertical direction with said seat.

28. A small watercraft as in claim 25, wherein said support frame is connected to said upper deck in a manner such that said support frame may be freely opened and closed and is removable from said upper deck, a quick-access opening formed in said engine cover, said engine opening being large enough for an engine to pass through, and said support opening being larger than said quick-access opening but smaller than said engine opening.

29. A small watercraft as in claim 25, further comprising a storage compartment provided in said upper deck, said storage compartment being located forward of said seat and said steering operator, said storage compartment being covered by a storage compartment cover that is freely opened and closed.

30. A small watercraft comprising a hull defining an engine compartment beneath at least a portion of an upper deck, an internal combustion engine housed within the engine compartment and driving a propulsion device to propel the watercraft, a rider's area including a seat supported by a suspension system that operates between the seat and the hull so as to absorb a portion of an impact force applied to the hull of said watercraft, the suspension system comprising front and rear supports that are arranged on either side of a center of the engine in the longitudinal direction, and that include front and rear cushioning elements, respectively, the front cushioning element being stiffer than the rear cushioning element.

31. A small watercraft comprising a hull defining an engine compartment beneath at least a portion of an upper deck, an internal combustion engine housed within the engine compartment and driving a propulsion device to propel the watercraft, a rider's area including a seat supported by a suspension system that operates between the seat and the hull so as to absorb a portion of an impact force applied to the hull of said watercraft, the suspension system comprising front and rear supports that are arranged on either side of a center of the engine in the longitudinal direction, the front and rear supports including front and rear cushioning elements, respectively, the rear cushioning element being configured to permit a greater degree of movement between the seat and the upper deck than does the front cushioning element.

32. A small watercraft comprising a hull defining an engine compartment beneath at least a portion of an upper deck, an internal combustion engine housed within the engine compartment and driving a propulsion device to propel the watercraft, a rider's area including a seat supported by a suspension system that operates between the seat and the hull so as to absorb a portion of an impact force applied to the hull of said watercraft, the suspension system comprising front and rear supports that are arranged on either sides of a center of gravity of the watercraft in a longitudinal direction, the front and rear supports including front and rear cushioning elements, respectively, the front cushioning element being stiffer than the rear cushioning element.

33. A small watercraft comprising a hull defining an engine compartment beneath at least a portion of an upper deck, an internal combustion engine housed within the engine compartment and driving a propulsion device to propel the watercraft, a rider's area including a seat supported by a suspension system that operates between the seat and the hull so as to absorb a portion of an impact force applied to the hull of said watercraft, the suspension system comprising front and rear supports that are arranged on either sides of a center of gravity of the watercraft in a longitudinal direction, the front and rear supports including front and rear cushioning elements, respectively, the rear cushioning element being configured to permit a greater degree of movement between the seat and the upper deck than does the front cushioning element.

34. A small watercraft comprising a hull defining an engine compartment beneath at least a portion of an upper deck, an internal combustion engine housed within the engine compartment and driving a propulsion device to propel the watercraft, a rider's area including a seat supported by suspension system that operates between the seat and the hull so as to absorb a portion of an impact force applied to the hull of said watercraft, the suspension system comprising front and rear supports at least one of which is connected by a quick-release coupling to the hull and the other one of the supports is pivotally connected to the hull.

35. A small watercraft as in claim 34, wherein a frame assembly supports the seat with the suspension system operating between the frame assembly and the upper deck.

36. A small watercraft as in claim 35, wherein the seat is removable connected to the frame so as to expose a section of the upper deck beneath the seat.

37. A small watercraft as in claim 36 additionally comprising an access opening formed in a portion of the upper deck beneath the seat, the access opening opening into the engine compartment, and a removable cover closing the access opening.

38. A small watercraft as in claim 35 additionally comprising a steering operator located in front of the seat and connected to the frame assembly.

39. A small watercraft as in claim 38, wherein a shock absorber is positioned to operate between the steering operator and the hull.

40. A small watercraft as in claim 34, wherein a releasably coupling connects one of the front and rear supports to the upper deck.

41. A small watercraft as in claim 34, wherein at least one of the supports is connected to the upper deck of the hull.

42. A small watercraft as in claim 34 further comprising an access opening formed with the hull and located at least in part beneath the seat, the access opening communicating with the engine compartment and when said quick release couplings are detached, the seat pivots about the supports that are pivotally connected to the hull such that said seat pivots away from the access opening so as to provide access to said engine compartment.

* * * * *